US011279107B2

(12) United States Patent
Corbin et al.

(10) Patent No.: US 11,279,107 B2
(45) Date of Patent: Mar. 22, 2022

(54) DUNNAGE CONVERSION MACHINE AND METHOD

(71) Applicant: Ranpak Corp., Concord Township, OH (US)

(72) Inventors: Douglas C. Corbin, Twinsburg, OH (US); Michael A. Steimle, Bainbridge, OH (US); Kevin Park, Chardon, OH (US)

(73) Assignee: Ranpak Corp., Concord Township, OH (US)

( * ) Notice: Subject to any disclaimer, the term of this patent is extended or adjusted under 35 U.S.C. 154(b) by 17 days.

(21) Appl. No.: 16/622,383

(22) PCT Filed: Jul. 19, 2018

(86) PCT No.: PCT/US2018/042821
§ 371 (c)(1),
(2) Date: Dec. 13, 2019

(87) PCT Pub. No.: WO2019/023035
PCT Pub. Date: Jan. 31, 2019

(65) Prior Publication Data

US 2020/0139660 A1 May 7, 2020

Related U.S. Application Data

(60) Provisional application No. 62/536,463, filed on Jul. 25, 2017.

(51) Int. Cl.
*B31D 5/00* (2017.01)

(52) U.S. Cl.
CPC ..... *B31D 5/0047* (2013.01); *B31D 5/006* (2013.01); *B31D 2205/0023* (2013.01);
(Continued)

(58) Field of Classification Search
CPC . B26D 1/085; B26D 5/20; B26D 7/14; B26D 2001/0066; B31D 5/0052;
(Continued)

(56) References Cited

U.S. PATENT DOCUMENTS 3,559,518 A * 2/1971 Domka ..... B26D 7/1818 83/124
4,213,385 A * 7/1980 Dahlem ..... B23D 31/008 100/295
(Continued)

FOREIGN PATENT DOCUMENTS

CN 1662315 A 8/2005
CN 106488841 A 3/2017
(Continued)

OTHER PUBLICATIONS

First Office Action dated Dec. 2, 2020, for related Chinese National Phase Application No. 201880050067.2.
(Continued)

*Primary Examiner* — Thomas M Wittenschlaeger
(74) *Attorney, Agent, or Firm* — Renner, Otto, Boisselle & Sklar, LLP

(57) ABSTRACT

A dunnage conversion machine converts a sheet stock material into a dunnage product that is relatively thicker and less dense than the stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the random crumpling is minimized or eliminated in an area to be cut to reduce or eliminate the production of scrap shards of sheet stock material during the cutting operation.

13 Claims, 20 Drawing Sheets

(52) U.S. Cl.
CPC ..... *B31D 2205/0047* (2013.01); *B31D 2205/0058* (2013.01); *B31D 2205/0082* (2013.01); *B31D 2205/0088* (2013.01); *B65H 2801/63* (2013.01)

(58) Field of Classification Search
CPC .... B31D 5/0043; B31D 5/0047; B31D 5/006; B31D 2205/0023; B31D 2205/0088; B31D 2205/0082; B31D 2205/0047; B31D 2205/0058; B65H 2801/63
See application file for complete search history.

(56) References Cited

U.S. PATENT DOCUMENTS 4,619,635 A * 10/1986 Ottaviano ..... B31D 5/0047 493/36
4,699,609 A * 10/1987 Komaransky ..... B26D 1/30 493/357
4,742,742 A * 5/1988 Yokoe ..... B65H 35/06 83/101
5,123,889 A * 6/1992 Armington ..... B31D 5/0047 493/352
5,558,923 A * 9/1996 Vesamaa ..... B31D 5/006 428/137
5,569,146 A * 10/1996 Simmons ..... B26D 1/08 493/352
5,658,229 A * 8/1997 Armington ..... B26D 1/30 493/363
5,938,580 A * 8/1999 Siekmann ..... B31D 5/0047 493/38
6,033,354 A * 3/2000 Baumuller ..... A61F 13/15723 493/372
6,080,097 A * 6/2000 Ratzel ..... B23Q 5/348 493/346
6,168,560 B1 * 1/2001 Pluymaekers ..... B31D 5/0047 493/340
6,174,273 B1 * 1/2001 Harding ..... B31D 5/0047 493/24
6,190,299 B1 * 2/2001 Simmons ..... B31D 5/0047 493/464
7,041,043 B2 * 5/2006 Lucassen ..... B31D 5/0047 493/464
7,955,245 B2 * 6/2011 Cheich ..... B31D 5/0052 493/464
9,427,928 B2 * 8/2016 Arora ..... B31D 5/0047
9,427,930 B2 * 8/2016 Wetsch ..... B31D 5/0052
10,035,320 B2 * 7/2018 Wetsch ..... B31D 5/0052
10,814,578 B2 * 10/2020 Schalk ..... B31D 5/0047
2009/0082187 A1 3/2009 Cheich
2016/0101585 A1 * 4/2016 Park ..... B31D 5/0047 493/10
2017/0066215 A1 * 3/2017 Cheich ..... B31D 5/0047
2020/0180255 A1 * 6/2020 Cheich ..... B31D 5/0043
2020/0180256 A1 * 6/2020 Cheich ..... B31D 5/0047

FOREIGN PATENT DOCUMENTS

DE 1922327 8/1965
DE 102012018867 A1 3/2014
JP S6261498 U 4/1987
JP 2003118017 A 4/2003
JP 2010540286 A 12/2010
WO 03/089163 A2 10/2003
WO 2018/071922 4/2018

OTHER PUBLICATIONS

International Preliminary Report on Patentability dated Jan. 28, 2020 for International Patent Application No. PCT/US2018/042821.
International Search Report and Written Opinion completed Dec. 3, 2018 for PCT/US2018/042821.
First Examination Report dated Aug. 26, 2020, for related Indian National Phase Patent Application No. 202017001078.

* cited by examiner

DUNNAGE CONVERSION MACHINE AND METHOD

RELATED APPLICATIONS

This application is a national phase of International Application No. PCT/US2018/042821 filed Jul. 19, 2018, and published in the English language, and which claims priority to U.S. Application No. 62/536,463 filed Jul. 25, 2017, both of which are hereby incorporated herein by reference.

FIELD OF THE INVENTION

The present invention is related to dunnage conversion machines, and more particularly to a cutting assembly and method for a dunnage conversion machine that produces a randomly-crumpled dunnage product from a sheet stock material.

BACKGROUND

Dunnage conversion machines convert a stock material into a relatively less dense dunnage product that can be used to pack articles and thus minimize or prevent damage during shipment. The dunnage conversion machines, also referred to as dunnage converters, include a conversion assembly that converts the stock material into a dunnage product as the stock material moves downstream through the conversion assembly from an inlet at an upstream end toward an outlet at a downstream end.

Exemplary dunnage conversion machines already in use convert a sheet stock material into a relatively less dense dunnage product and in the process randomly crumple at least a portion of the sheet stock material. Such dunnage conversion machines typically convert a substantially continuous length of sheet stock material into a strip of dunnage, from which discrete dunnage products are severed for use.

SUMMARY

The randomness of the crumpling of the sheet stock material has been found to create a potential problem in the severing operation. When a cutting blade moves through a plane across which a strip of dunnage extends, a randomly crumpled sheet can extend back and forth across the plane, resulting in loose shards of sheet material being produced as the cutting blade moves across the plane. These loose shards of material can build up, potentially increasing the opportunity for jamming, increasing waste, interfering with optical sensors, or simply making a mess on the floor.

The dunnage conversion machine and method provided by the present invention address this problem by temporarily reducing the random crumpling in a portion of the sheet stock material moving through the conversion assembly, and cutting the sheet stock material in a resulting reduced crumpling portion.

Paraphrasing the claims, the present invention provides a dunnage conversion machine for converting a sheet stock material into a relatively lower density dunnage product. The dunnage conversion machine includes a conversion assembly configured to advance a sheet stock material therethrough and to selectively randomly crumple at least a portion of the sheet stock material, a cutting assembly downstream of the conversion assembly; and a controller in communication with the conversion assembly and the cutting assembly. The controller is configured to control the conversion assembly to temporarily reduce the random crumpling in a portion of the sheet stock material and then activate the cutting assembly to sever a discrete strip of dunnage from the sheet stock material by cutting the strip of sheet stock material in the portion of the sheet stock material having the reduced crumpling.

The dunnage conversion machine may further include a conversion assembly that includes a feed assembly for advancing at least a first web of sheet stock material therethrough at a first rate; and a connecting assembly downstream of the feed assembly that (a) retards the advancement of the sheet stock material by passing the sheet stock material therethrough at a second rate that is less than the first rate, thereby causing the first web to randomly crumple in a longitudinal space between the feed assembly and the connecting assembly, and (b) connects the crumpled first web to a second web to maintain the crumpled first web in its crumpled state.

The feed assembly may include at least one pair of rotating members for advancing sheet stock material therebetween.

The connecting assembly may include at least one pair of rotating gear members having interlaced teeth for deforming the sheet stock material passing therebetween to interlock multiple plies of sheet stock material.

The conversion assembly may include one or more tunnel members that define a path for the sheet stock material through the conversion assembly.

The present invention also provides a method for converting a sheet stock material into a relatively lower density dunnage product. The method includes the steps of: (a) advancing a sheet stock material through a conversion assembly and randomly crumpling at least a portion of the sheet stock material to form a strip of dunnage; and then (b) temporarily advancing the sheet stock material through the conversion assembly without randomly crumpling the sheet stock material to form an uncrumpled portion of the strip of dunnage; and then (c) cutting the uncrumpled portion of the strip of dunnage to sever a discrete dunnage product from the strip of dunnage.

The randomly crumpling step may include (i) retarding the passage of the sheet stock material downstream of a feed assembly portion of the conversion assembly by passing the sheet stock material at a second rate that is less than the first rate to cause the first web to randomly crumple; and (ii) connecting multiple layers of sheet stock material, including connecting the crumpled first web to one side of a second web of sheet stock material, to hold the crumpled first web in its crumpled state.

The present invention also provides a dunnage conversion machine for converting a sheet stock material into a dunnage product that includes (a) means for advancing a sheet stock material and randomly crumpling at least a portion of the sheet stock material to form a strip of dunnage; (b) means for temporarily advancing the sheet stock material without randomly crumpling the sheet stock material to form an uncrumpled portion of the strip of dunnage; and (c) means for cutting the uncrumpled portion of the strip of dunnage to sever a discrete dunnage product from the strip of dunnage.

The means for advancing and the means for temporarily advancing the sheet stock material may include a conversion assembly having a feed assembly and a connecting assembly, and a suitable controller configured to control the feed assembly and the connecting assembly, as described herein.

The present invention further provides a dunnage conversion machine for converting a sheet stock material into a relatively lower density dunnage product that includes a conversion assembly configured to advance a sheet stock material therethrough along a path from an upstream end toward a downstream end and to randomly crumple at least a portion of the sheet stock material, and a cutting assembly downstream of the conversion assembly. The cutting assembly includes a stationary cutting blade on one side of the path of the sheet stock material and a movable cutting blade that is movable from a conversion position removed from the path of the sheet stock material opposite the stationary cutting blade, across the path to a cut position adjacent the stationary cutting blade. The cutting assembly further includes an upstream flattening plow coupled to an upstream side of the movable cutting blade for movement therewith and a downstream flattening plow coupled to a downstream side of the movable cutting blade for movement therewith.

The conversion assembly may include a feed assembly for advancing at least a first web of sheet stock material therethrough at a first rate, and a connecting assembly downstream of the feed assembly that (a) retards the advancement of the sheet stock material by passing the sheet stock material therethrough at a second rate that is less than the first rate, thereby causing the first web to randomly crumple in a longitudinal space between the feed assembly and the connecting assembly, and (b) connects the crumpled first web to a second web to maintain the crumpled first web in its crumpled state.

The feed assembly may include at least one pair of rotating members for advancing sheet stock material therebetween.

The connecting mechanism may include at least one pair of rotating gear members having interlaced teeth for deforming the sheet stock material passing therebetween to interlock multiple plies of sheet stock material.

The conversion assembly may include one or more tunnel members that define a path for the sheet stock material through the conversion assembly.

The present invention also provides a method for converting a sheet stock material into a relatively lower density dunnage product, that includes the following steps: (a) advancing a sheet stock material through a conversion assembly and randomly crumpling at least a portion of the sheet stock material to form a strip of dunnage, (b) stretching the strip of dunnage to reduce the crumpling in a portion of the strip of dunnage, and (c) cutting the reduced-crumpling portion of the strip of dunnage to sever a discrete dunnage product from the strip of dunnage.

The randomly crumpling step may include the steps of (i) retarding the passage of the sheet stock material downstream of the feed assembly portion of the conversion assembly by passing the sheet stock material at a second rate that is less than the first rate to cause the first web to randomly crumple, and (ii) connecting multiple layers of sheet stock material, including connecting the crumpled first web to one side of a second web of sheet stock material, to hold the crumpled first web in its crumpled state.

The present invention also provides a dunnage conversion machine for converting a sheet stock material into a dunnage product that includes (a) means for advancing a sheet stock material and randomly crumpling at least a portion of the sheet stock material to form a strip of dunnage, (b) means for stretching the strip of dunnage to reduce the crumpling in a portion of the strip of dunnage, and (c) means for cutting the reduced-crumpling portion of the strip of dunnage to sever a discrete dunnage product from the strip of dunnage.

The present invention also could be characterized as providing a dunnage conversion machine for converting a sheet stock material into a relatively lower density dunnage product that includes a conversion assembly configured to advance a sheet stock material therethrough and to randomly crumple at least a portion of the sheet stock material, a cutting assembly downstream of the conversion assembly, and means for reducing the crumpling in a portion of the sheet stock material coupled to one or more of the conversion assembly and the cutting assembly.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

The present invention provides a dunnage conversion machine with a cutting assembly and a corresponding method for a dunnage conversion machine that converts a sheet stock material into a dunnage product that is relatively thicker and less dense than the stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the conversion assembly temporarily advances the sheet stock material therethrough while minimizing or eliminating the random crumpling of the sheet stock material in a reduced-crumpling zone, and then cuts the sheet stock material in the reduced-cutting zone to reduce or eliminate the production of scrap shards of sheet stock material.

The randomness of the crumpling of the sheet stock material has been found to create a potential problem. When a cutting blade moves through a plane across which a strip of dunnage extends, a randomly crumpled sheet may extend back and forth across the plane, resulting in loose shards of sheet material being producing as the cutting blade moves across the plane. These loose shards of material can build up, potentially increasing the likelihood of jamming, increasing waste, interfering with optical sensors, or causing other problems.

The dunnage conversion machine and method provided by the present invention temporarily reduces the random crumpling in a portion of the sheet stock material moving through the conversion assembly, and then cuts the sheet stock material in the resulting reduced-crumpling portion.

The present disclosure includes drawings and descriptions of an exemplary dunnage conversion machine that produces a wrappable dunnage product, but the present invention is not limited to the illustrated dunnage conversion machine.

Figure 1:
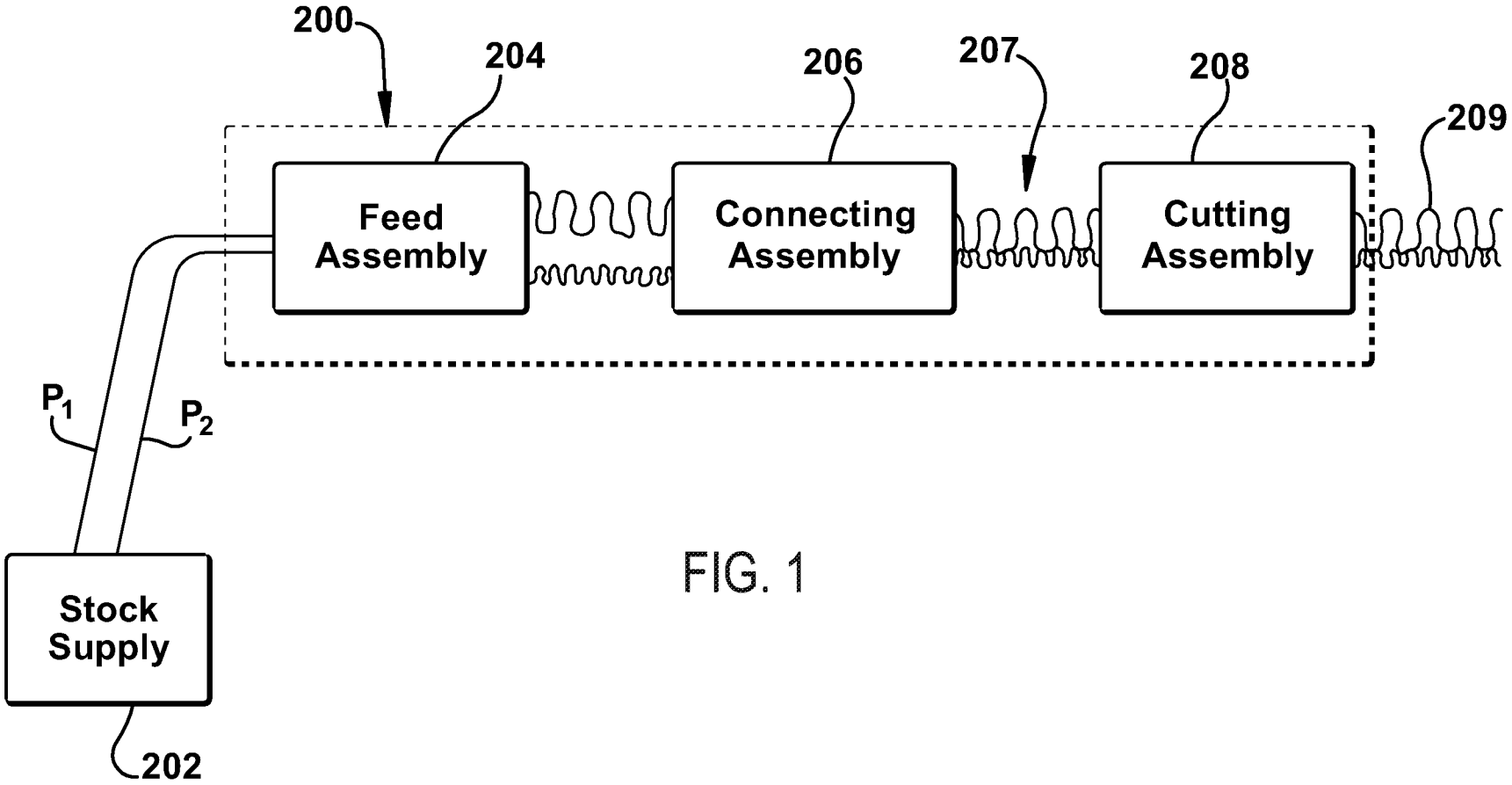
FIG. 1 is a schematic representation of an exemplary dunnage conversion machine provided in accordance with the present invention.

Referring now to the drawings in detail, and initially FIG. 1, which shows a schematic dunnage conversion machine 200 provided in accordance with the present invention that converts a sheet stock material into a wrapping dunnage product. The dunnage conversion machine 200 includes a supply of sheet stock material 202, and a conversion assembly that includes both a feed assembly 204 that draws multiple plies $P_1$ and $P_2$ of sheet stock material from the supply, and a connecting assembly 206 downstream from the feed assembly 204 that connects multiple overlapping plies together to form a strip of dunnage 207. A suitable sheet stock material includes paper and/or plastic sheets, supplied as a roll or a fan-folded stack, for example. An exemplary sheet stock material for use in the conversion machine 200 includes either a single ply or a multi-ply kraft paper provided either in roll form or as a series of connected rectangular pages in a fan-folded stack. Paper is an environmentally-responsible choice for a sheet stock material because it generally is recyclable, reusable, and composed of a renewable resource. Multiple rolls or stacks may be used to provide the multiple sheets or webs of stock material for conversion to the multi-ply dunnage product, and subsequent rolls or stacks may be spliced to trailing ends of preceding rolls or stacks to provide a continuous length of sheet stock material to the dunnage conversion machine 200.

The connecting assembly 206 connects multiple overlying sheets of the stock material, including connecting at least one crumpled first sheet to one side of another or second sheet, to form a crumpled strip of dunnage. The second sheet may be a crumpled sheet that also passes through the feed assembly 204 or an uncrumpled sheet that bypasses the feed assembly 204.

The connecting assembly 206 typically passes the plies or sheets of stock material therethrough at a slower rate than the rate at which the plies are fed from the feed assembly 204, thereby cooperating with the feed assembly 204 to cause the stock material to randomly longitudinally crumple or fold in a confined space extending longitudinally between the feed assembly 204 and the connecting assembly 206.

The conversion machine 200 also includes a cutting assembly 208 downstream of the connecting assembly 206 that severs discrete lengths of a wrapping dunnage product 209 from the strip 207.

The converter 200 further includes a controller 211 that enables selection of a desired length of the dunnage product 209. The controller 211 typically includes a processor 213 a memory 215, and a program stored in the memory. The controller 211 also includes one or more input devices 217 for determining the selected length and one or more outputs for controlling elements of the conversion assembly, namely the feed assembly 204 and the connecting assembly 206, as well as the cutting assembly 208. The input devices 217 can be connected to or include one or more of a keyboard, mouse, touch screen display, a scanner or sensor, a bar code reader for reading a bar code on a container that receives the dunnage products, a radio frequency identification device (RFID) sensor, microphone, camera, etc. The controller 211 can be programmed to recognize the appropriate inputs that represent a selected length or identify a location to look up one or multiple lengths needed for a particular packing container.

The outputs from the controller 211 can control various motors that drive elements of the conversion assembly, such as the illustrated feed assembly 204, connecting assembly 206, and cutting assembly 208. In the illustrated embodiment the controller 211 also may control a solenoid motor, whose purpose will be further explained below.

In accordance with a first embodiment of the present invention, the controller 211 is configured to selectively control operation of the feed assembly 204, such as by selectively engaging the feed assembly 204 to feed the sheet stock material therethrough as fast as or faster than the sheet material is being drawn through the connecting assembly 206 and thereby control whether or not the feed rate differential is sufficient to cause or minimize crumpling. In particular, the controller 211 may be configured to reduce or eliminate crumpling in a portion of the sheet material, even while continuing to advance the sheet material, and then cutting the sheet material in the reduced crumpling portion. The reduced crumpling portion extends across the width of the sheet stock material and extends a substantial length of the sheet stock material to account for variations in displacement of that reduced crumpling region from the conversion assembly to the cutting assembly 208. By reducing or eliminating crumpling in a portion of the sheet stock material that is to be cut by the cutting assembly 208, fewer loose shards of sheet material are created by the cutting operation.

Figure 2:
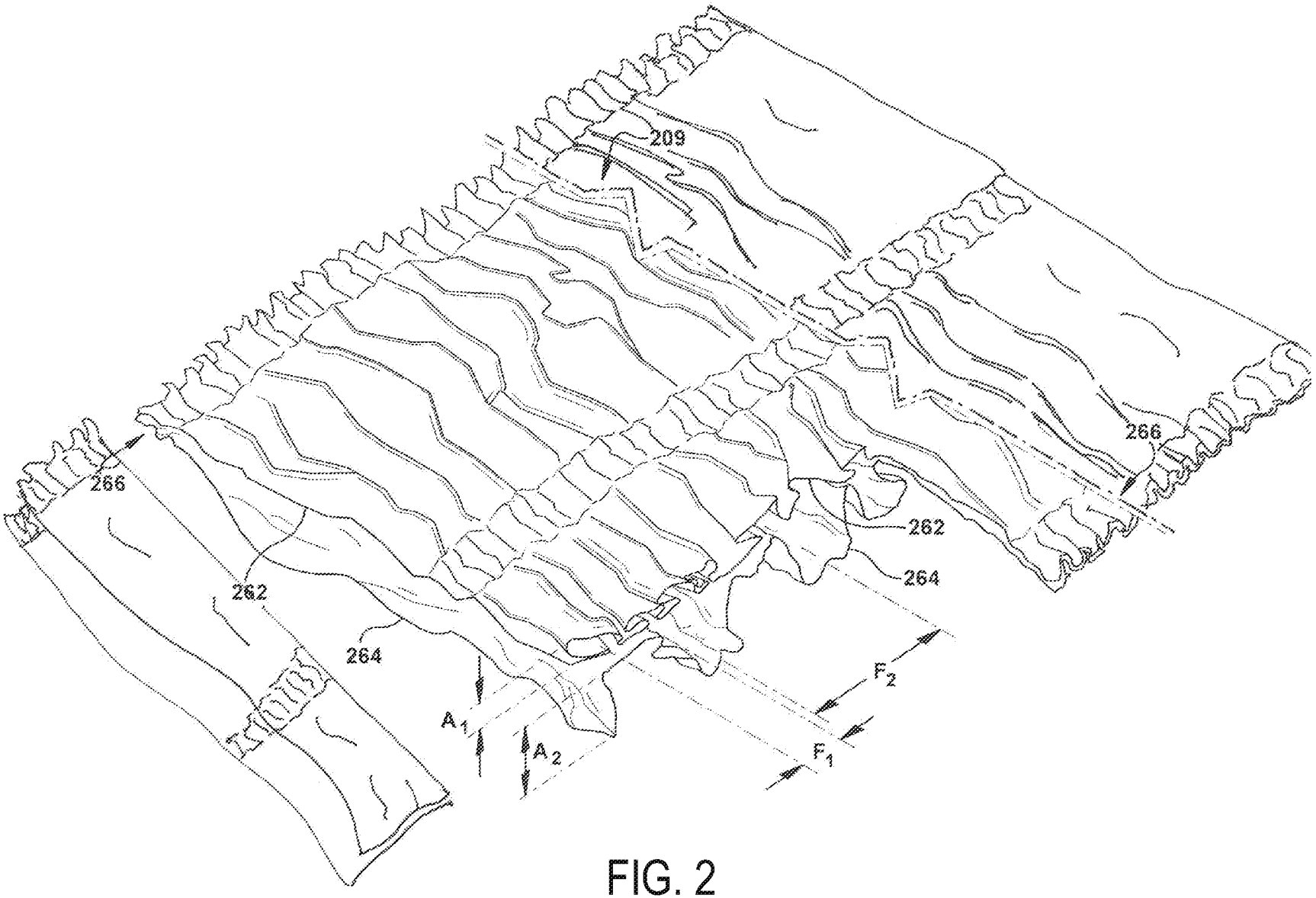
FIG. 2 is a schematic perspective view of a dunnage product produced by the dunnage conversion machine of FIG. 1.
Figure 3:
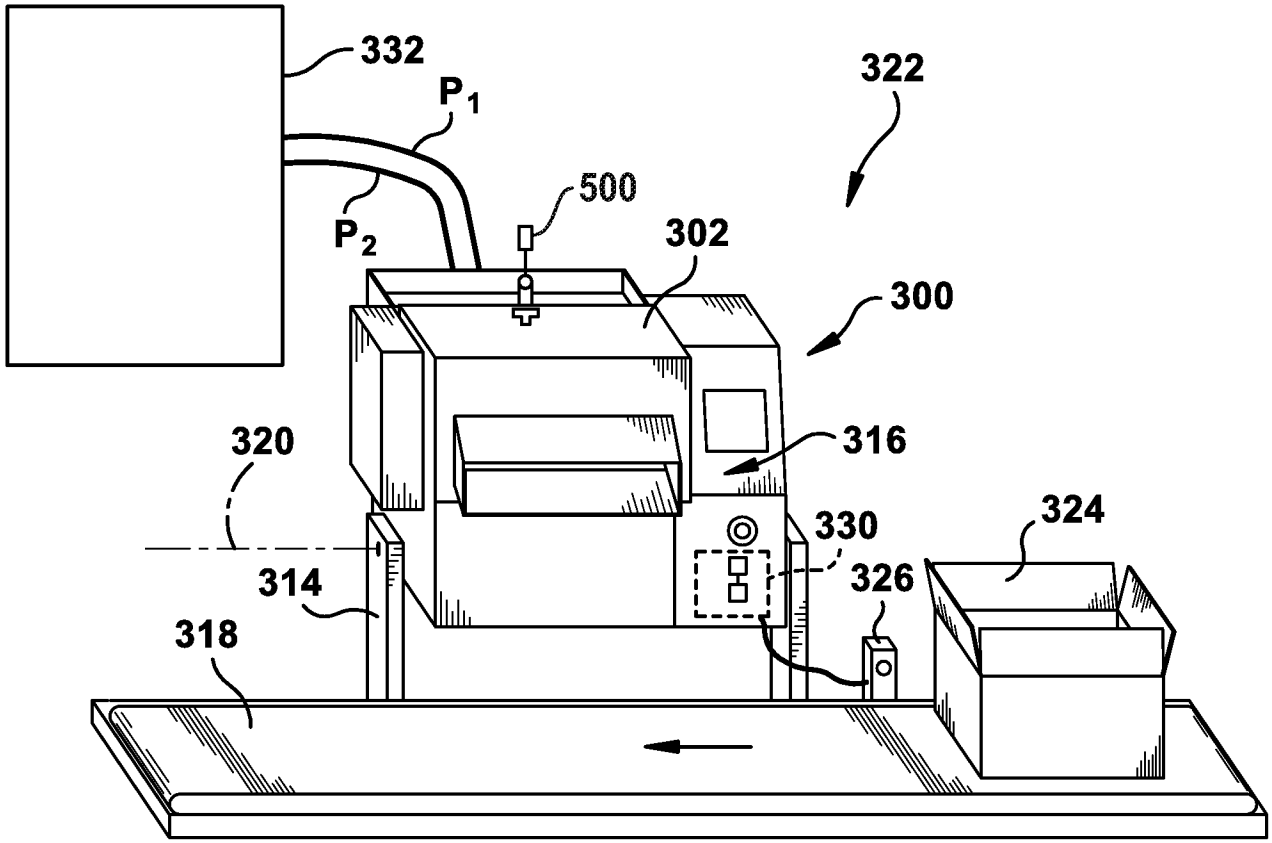
FIG. 3 is a schematic perspective view of a packaging system including a dunnage conversion machine provided in accordance with the present invention.
Figure 4:
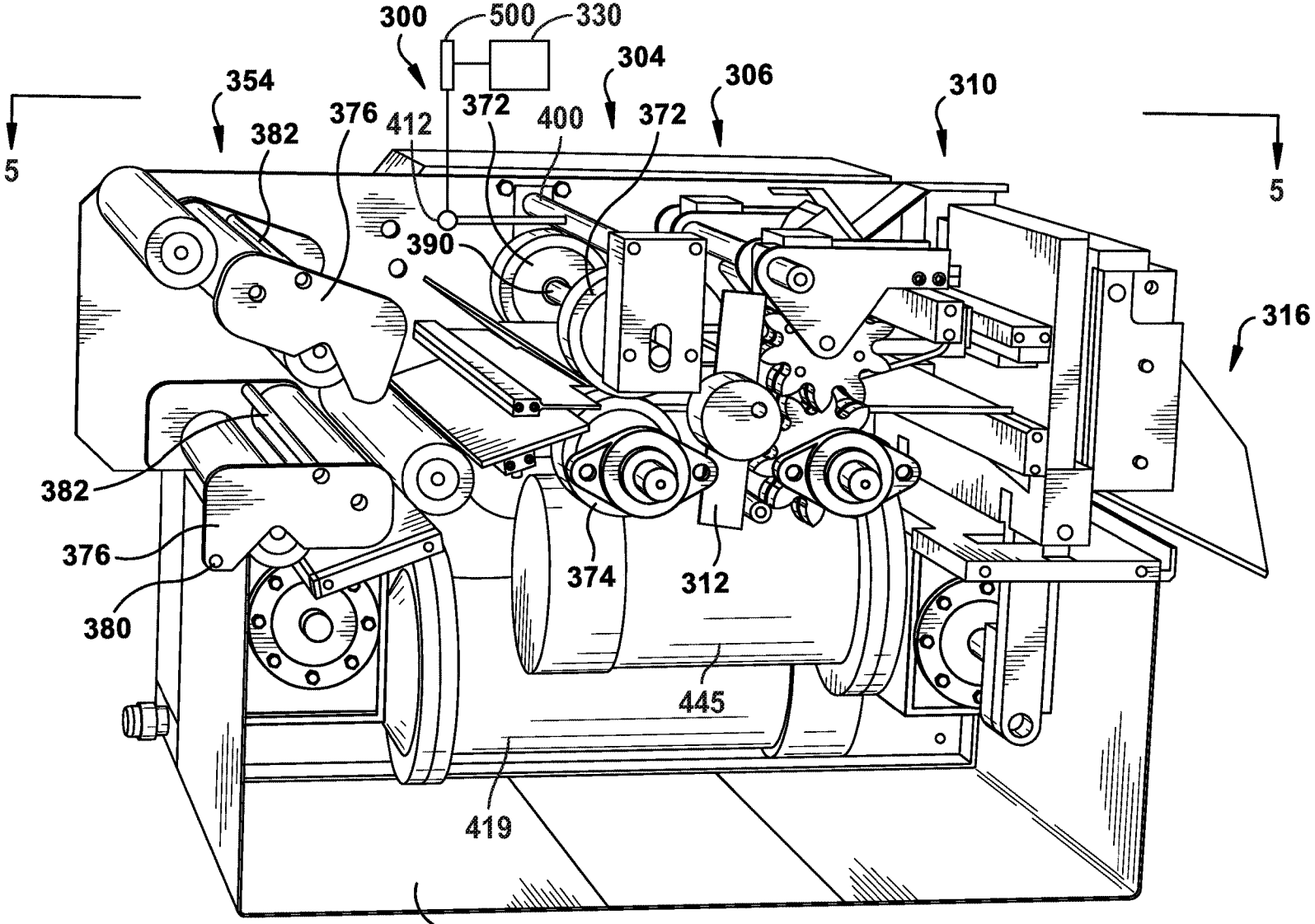
FIG. 4 is a perspective view of the dunnage conversion machine of FIG. 3 with the left side and top panels of its housing removed to reveal the internal components.
Figure 5:
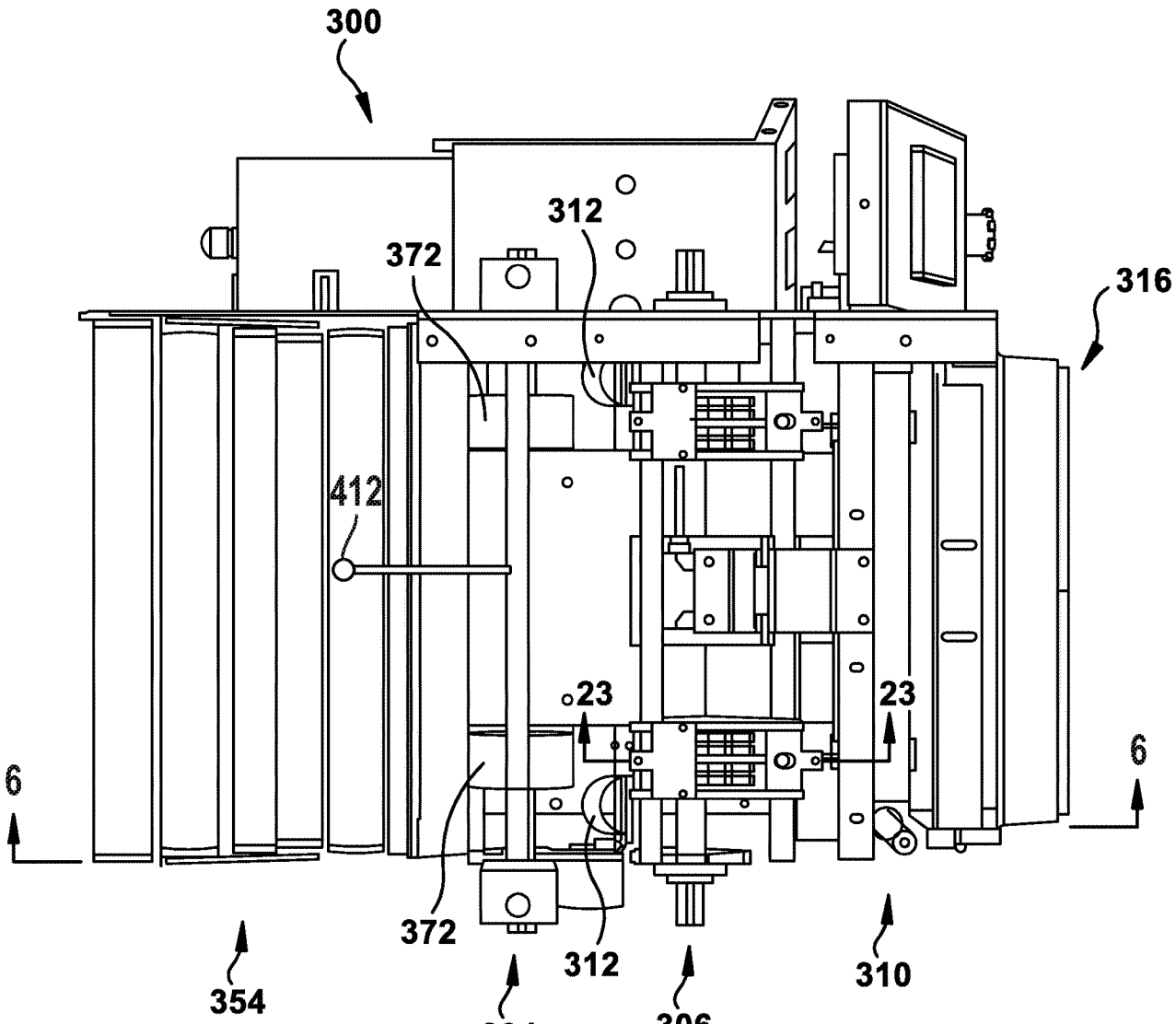
FIG. 5 is a top view of the dunnage conversion machine of FIG. 4, looking in direction 5-5 in FIG. 4.
Figure 6:
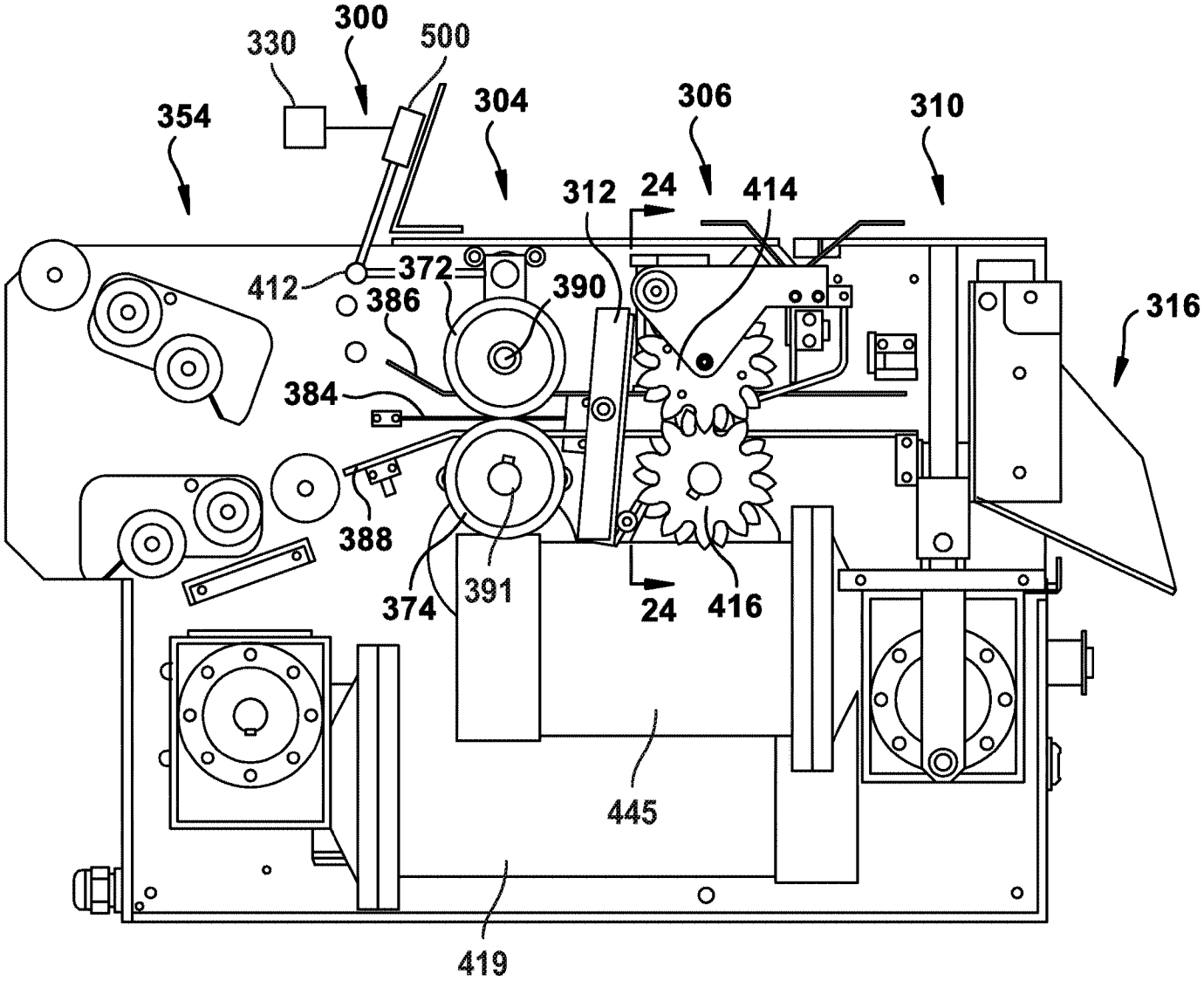
FIG. 6 is a cross-sectional side view of the dunnage conversion machine of FIG. 3, looking in direction 6-6 in FIG. 5.
Figure 7:
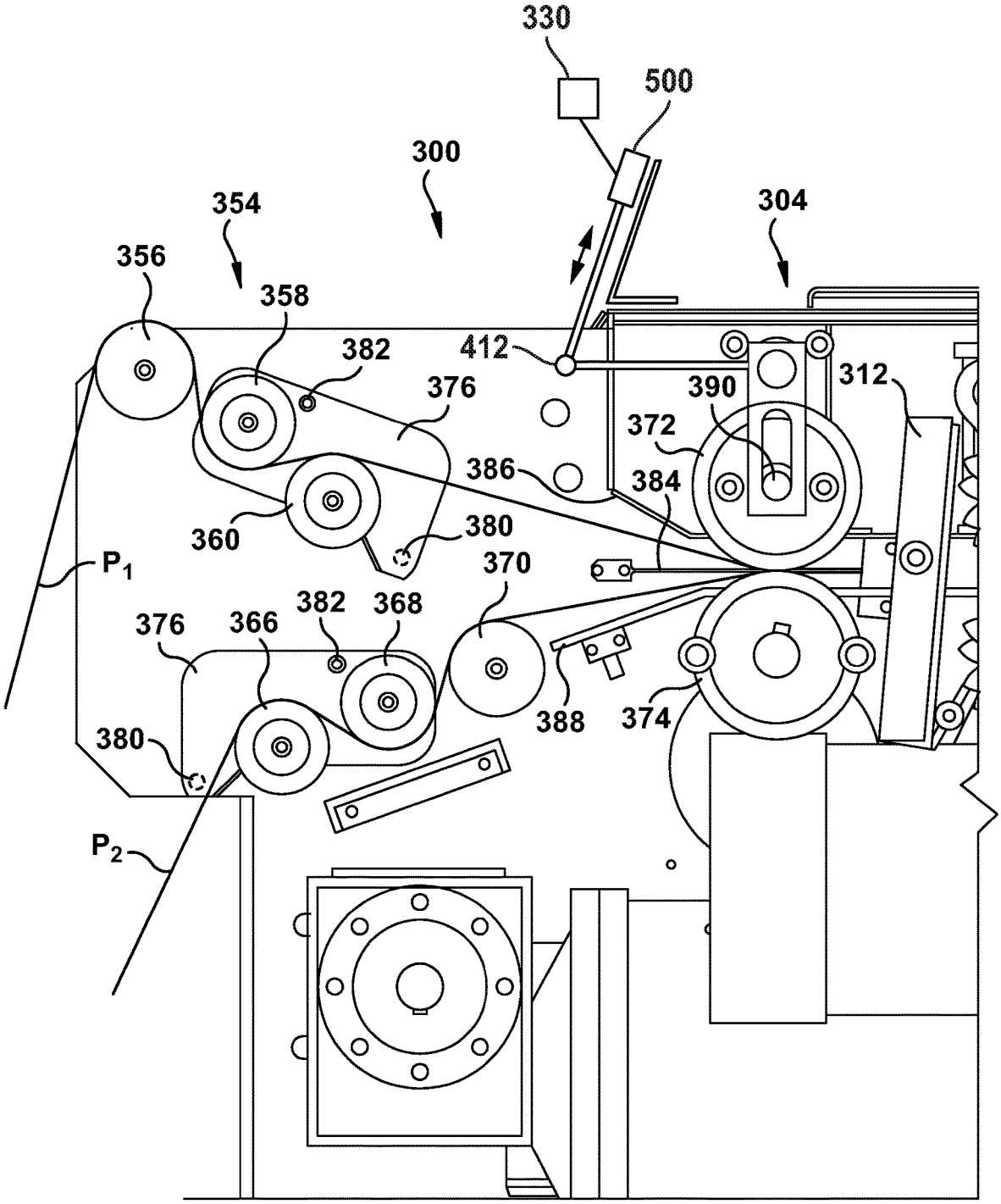
FIG. 7 is an enlarged side view of an upstream end of the dunnage conversion machine of FIG. 3.
Figure 8:
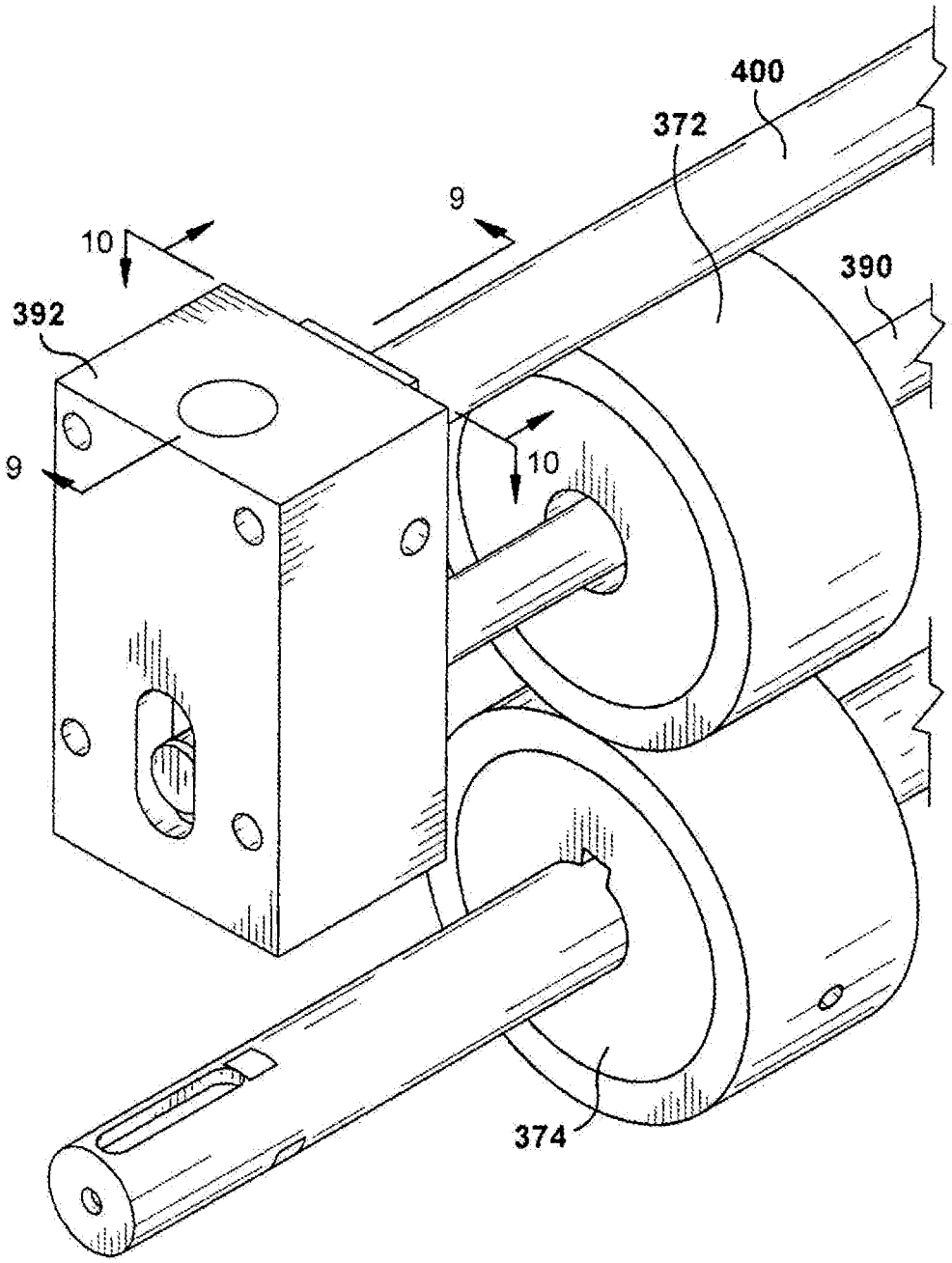
FIG. 8 is an enlarged schematic perspective view of a portion of a feed assembly of the dunnage conversion machine of FIG. 3.
Figure 9:
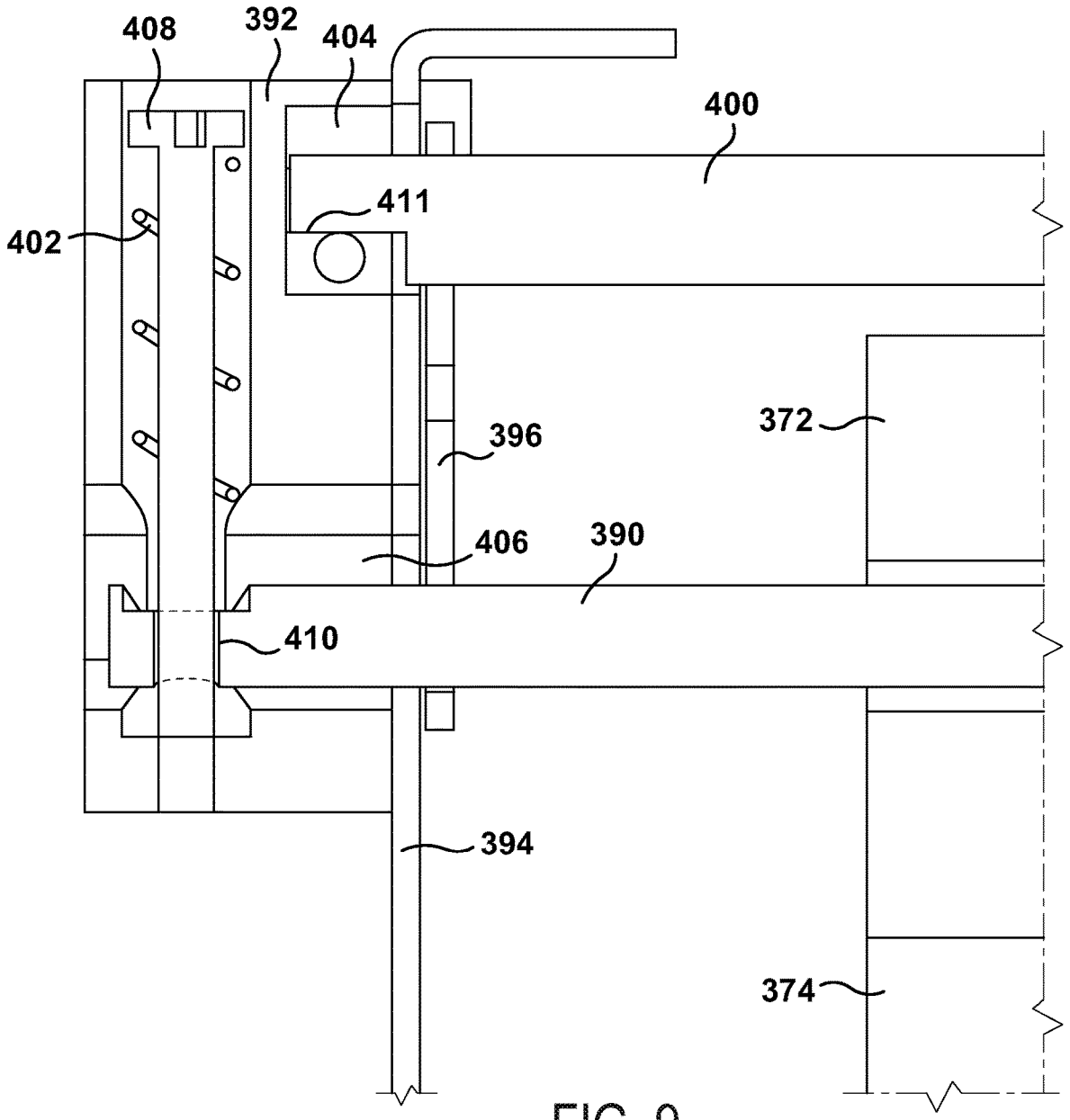
FIG. 9 is a cross-sectional view of FIG. 8 taken along lines 9-9 and looking in the indicated direction represented by the corresponding arrows.
Figure 10:
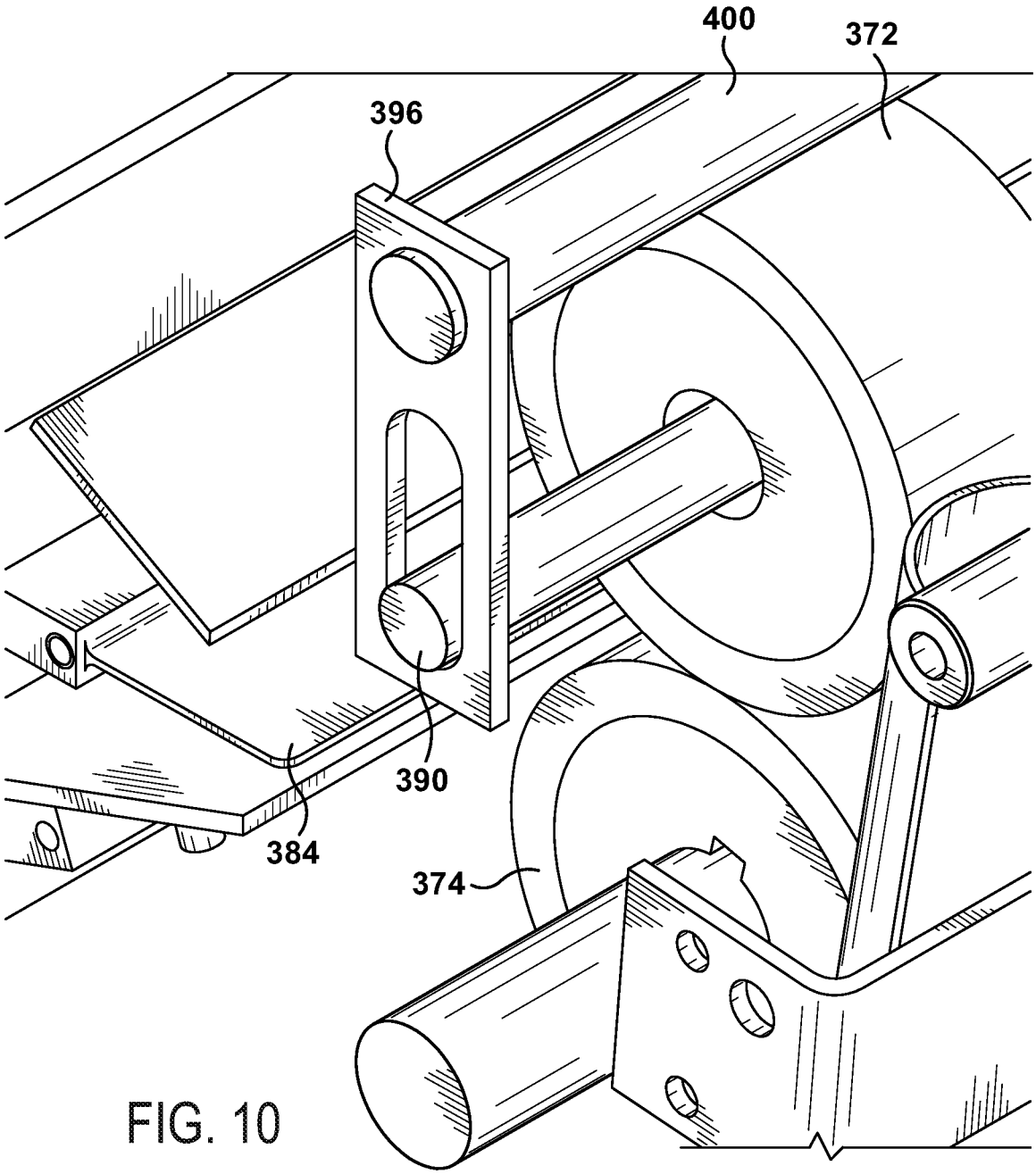
FIG. 10 is a cross-sectional view of FIG. 8 taken along lines 10-10 and looking in the direction indicated by the corresponding arrows.
Figure 11:
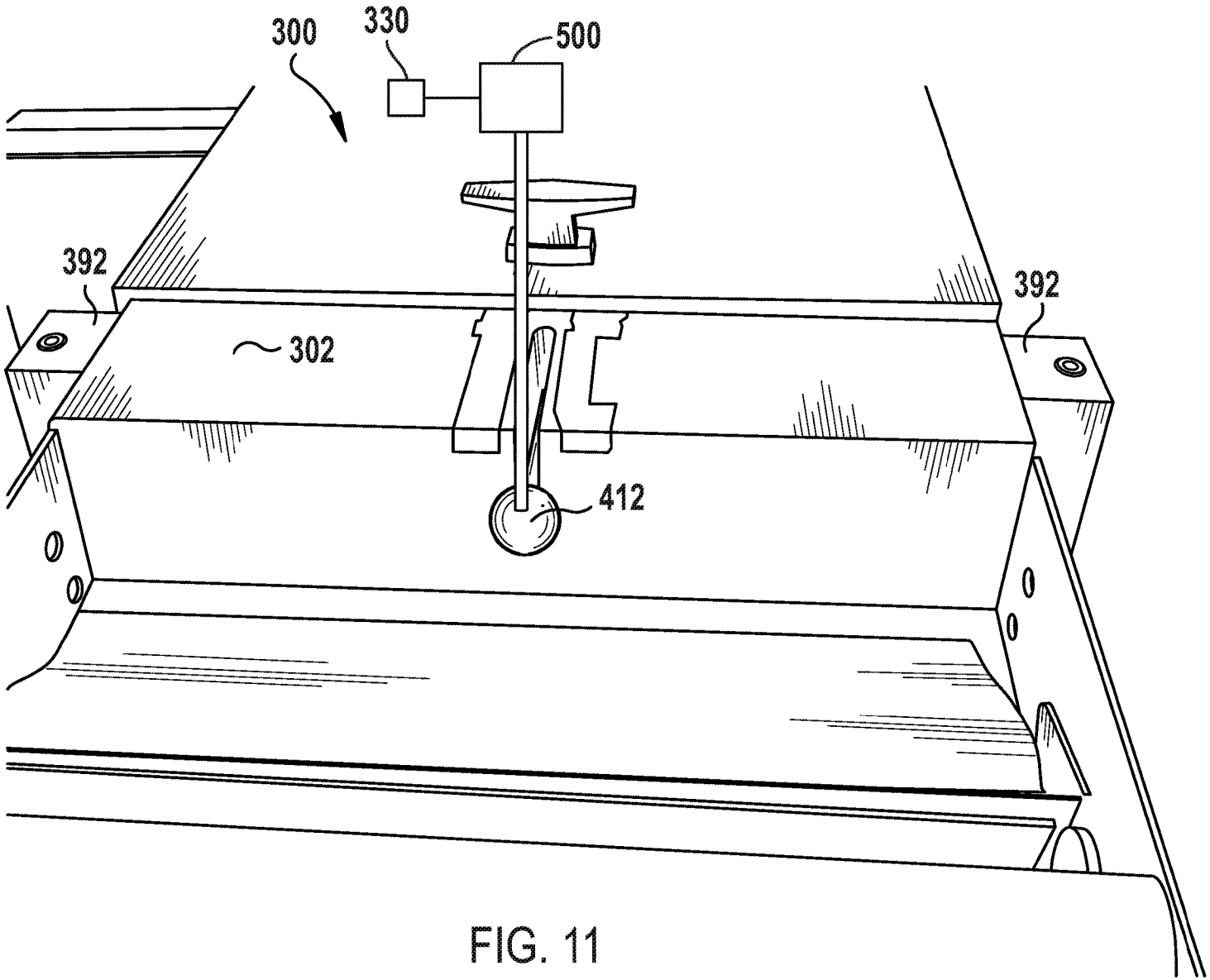
FIG. 11 is a perspective view of a rear, upper portion of the dunnage conversion machine of FIG. 3.
Figure 12:
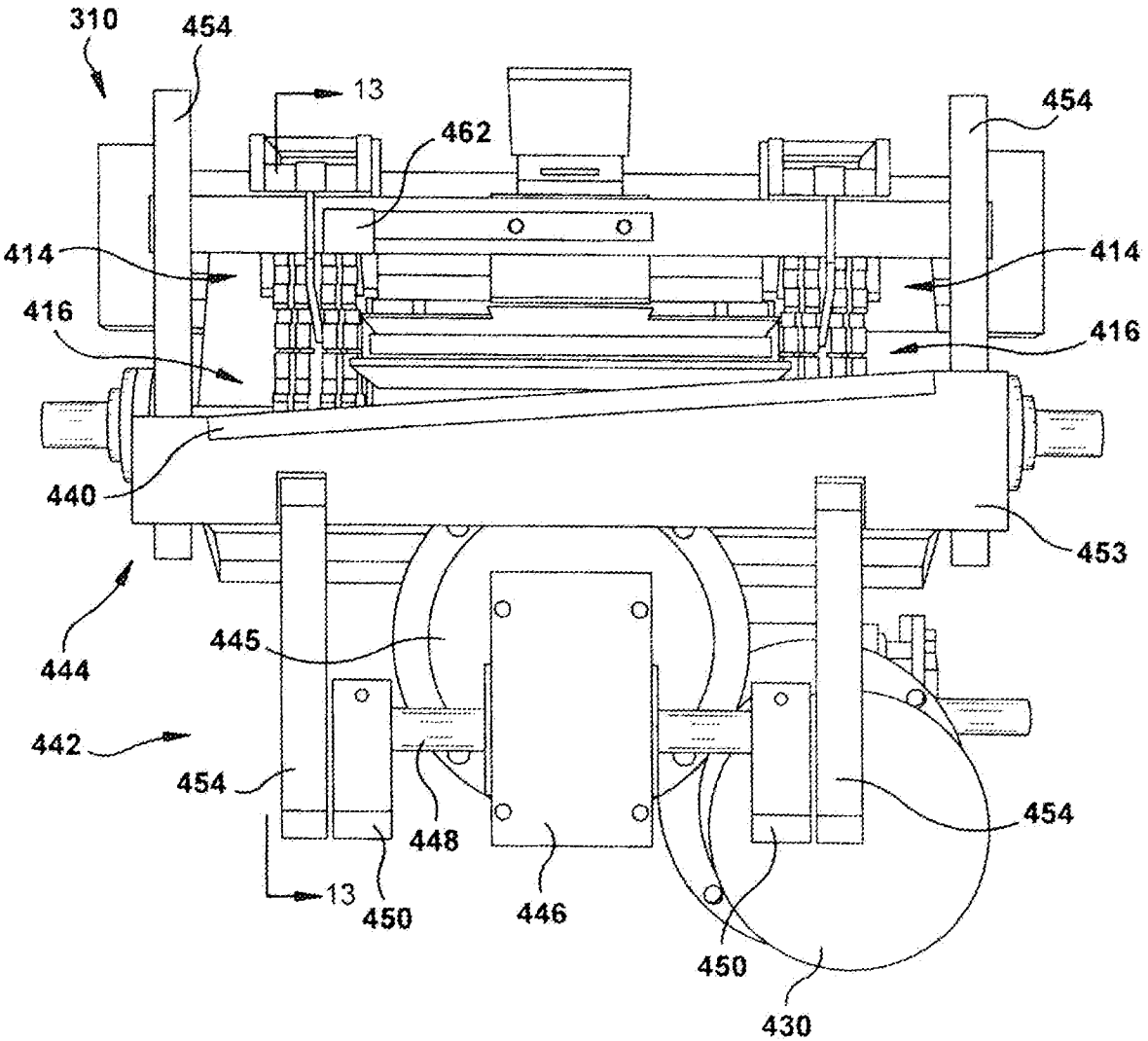
FIG. 12 is a front elevation view of a downstream portion of the dunnage conversion machine of FIG. 3 with the housing removed to reveal a cutting assembly.
Figure 13:
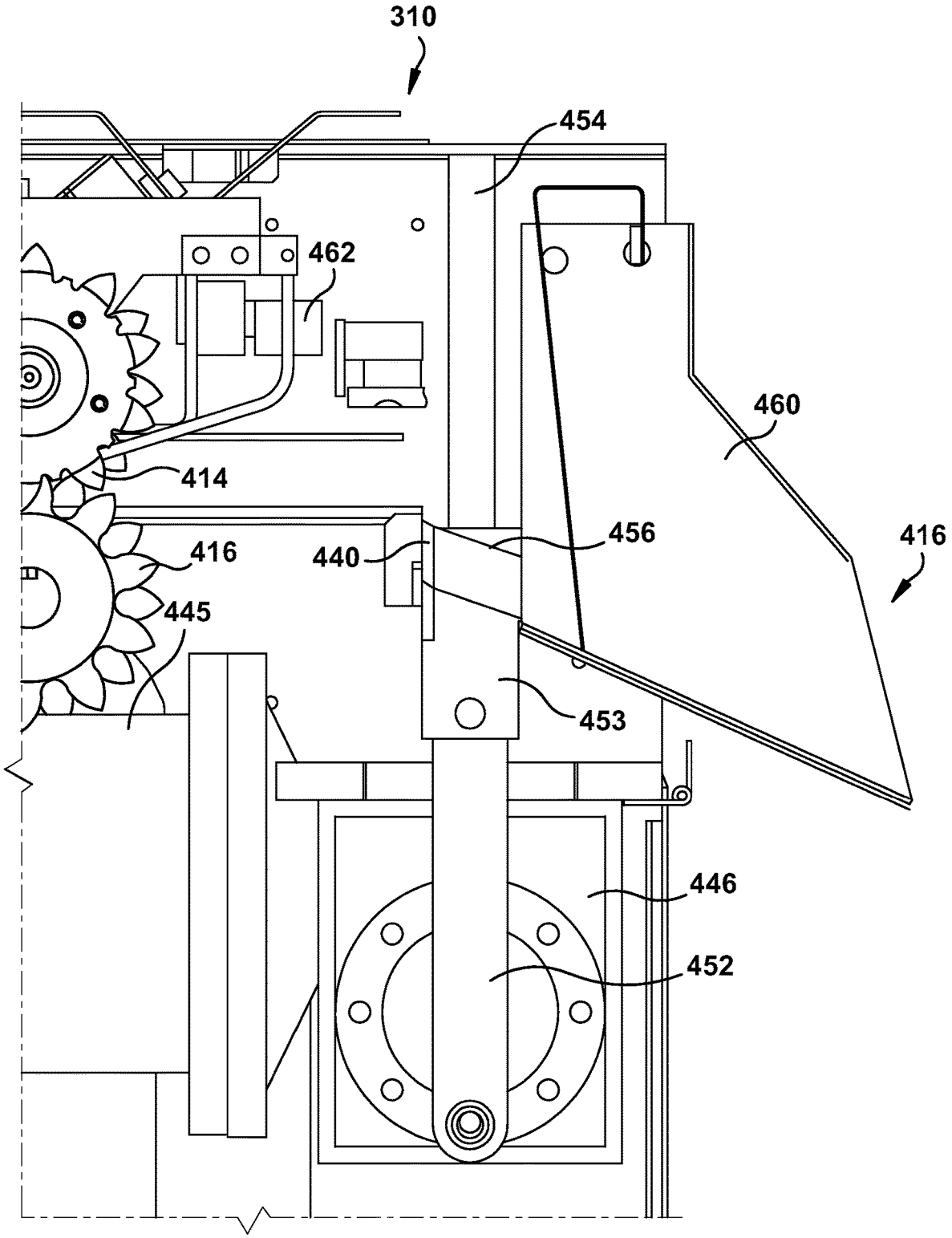
FIG. 13 is an enlarged cross-sectional view of the cutting assembly of FIG. 12 as seen along lines 13-13.
Figure 14:
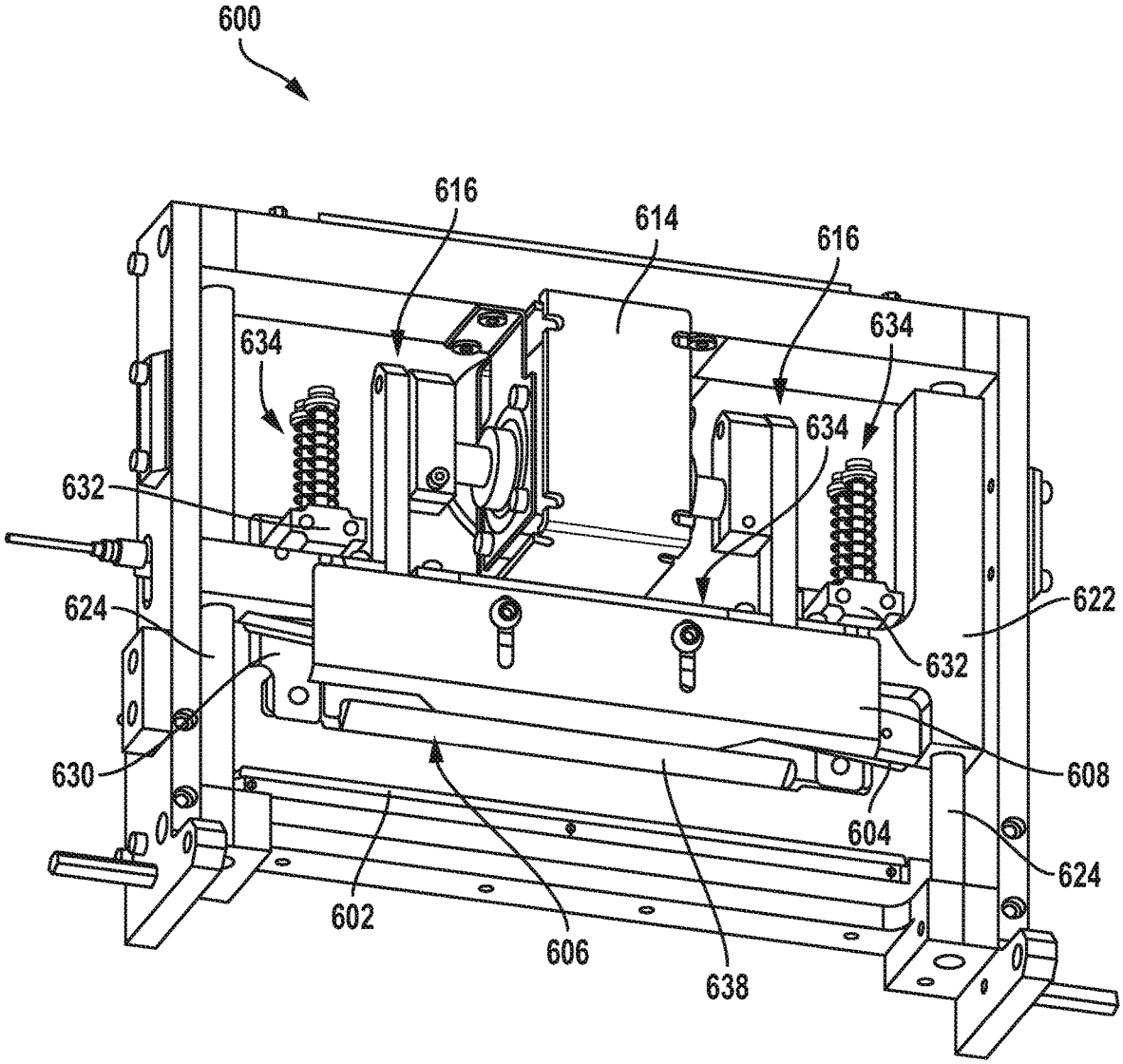
FIG. 14 is a front perspective view of another embodiment of a cutting assembly provided by the invention.
Figure 15:
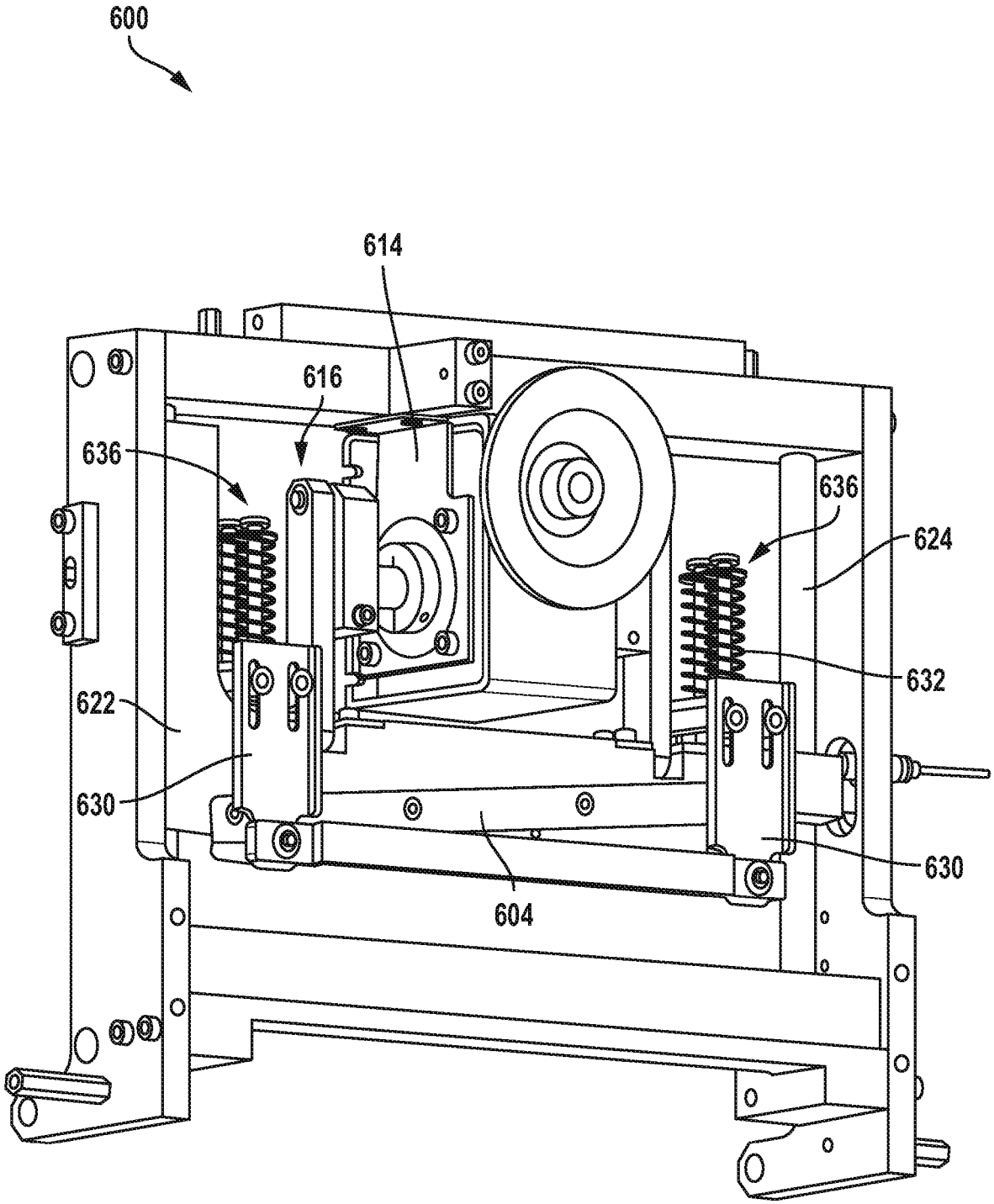
FIG. 15 is a rear perspective view of the cutting assembly of FIG. 14.
Figure 16:
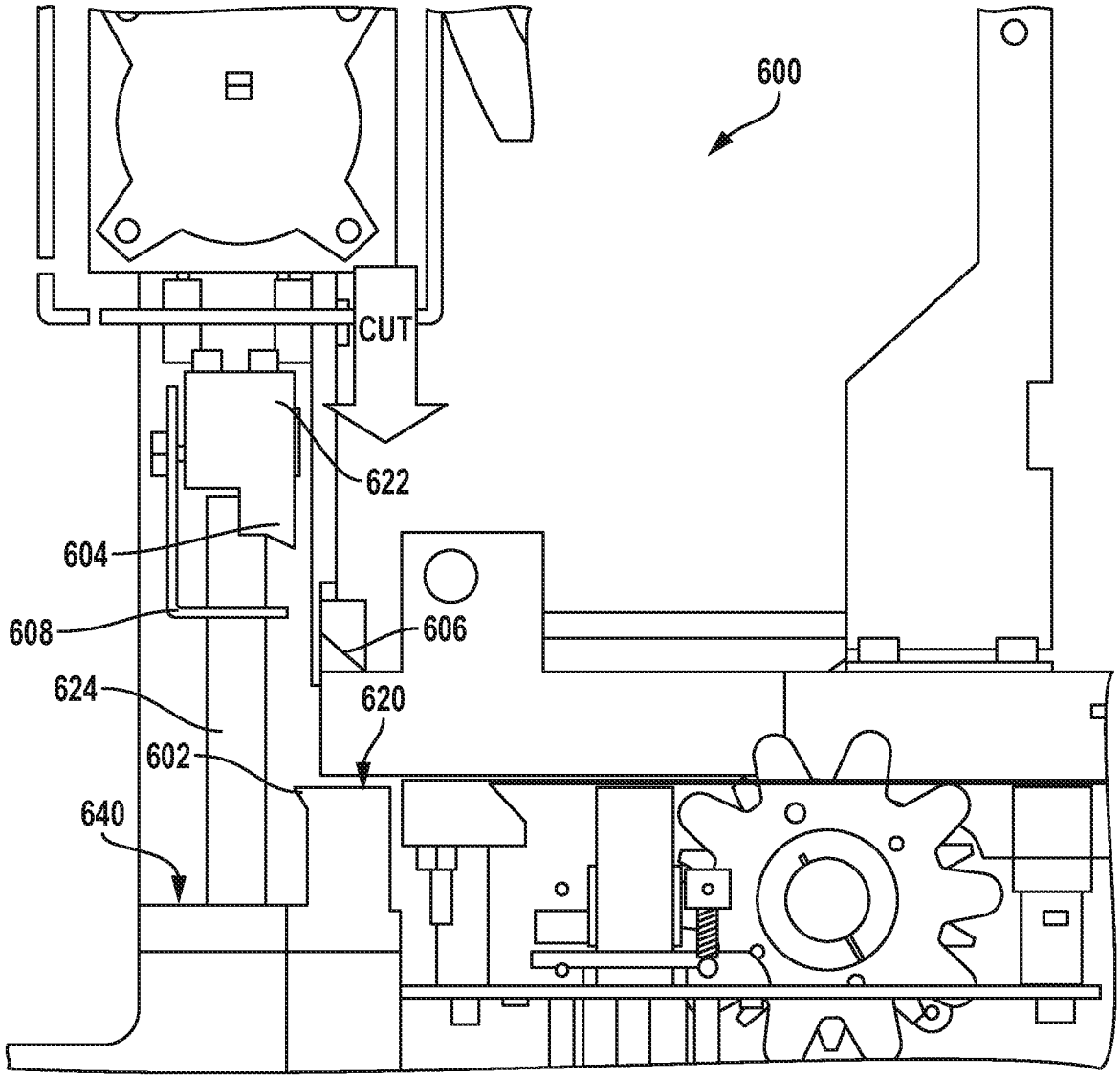
FIG. 16 is a schematic cross-sectional view of the cutting assembly of FIG. 14.
Figure 17:
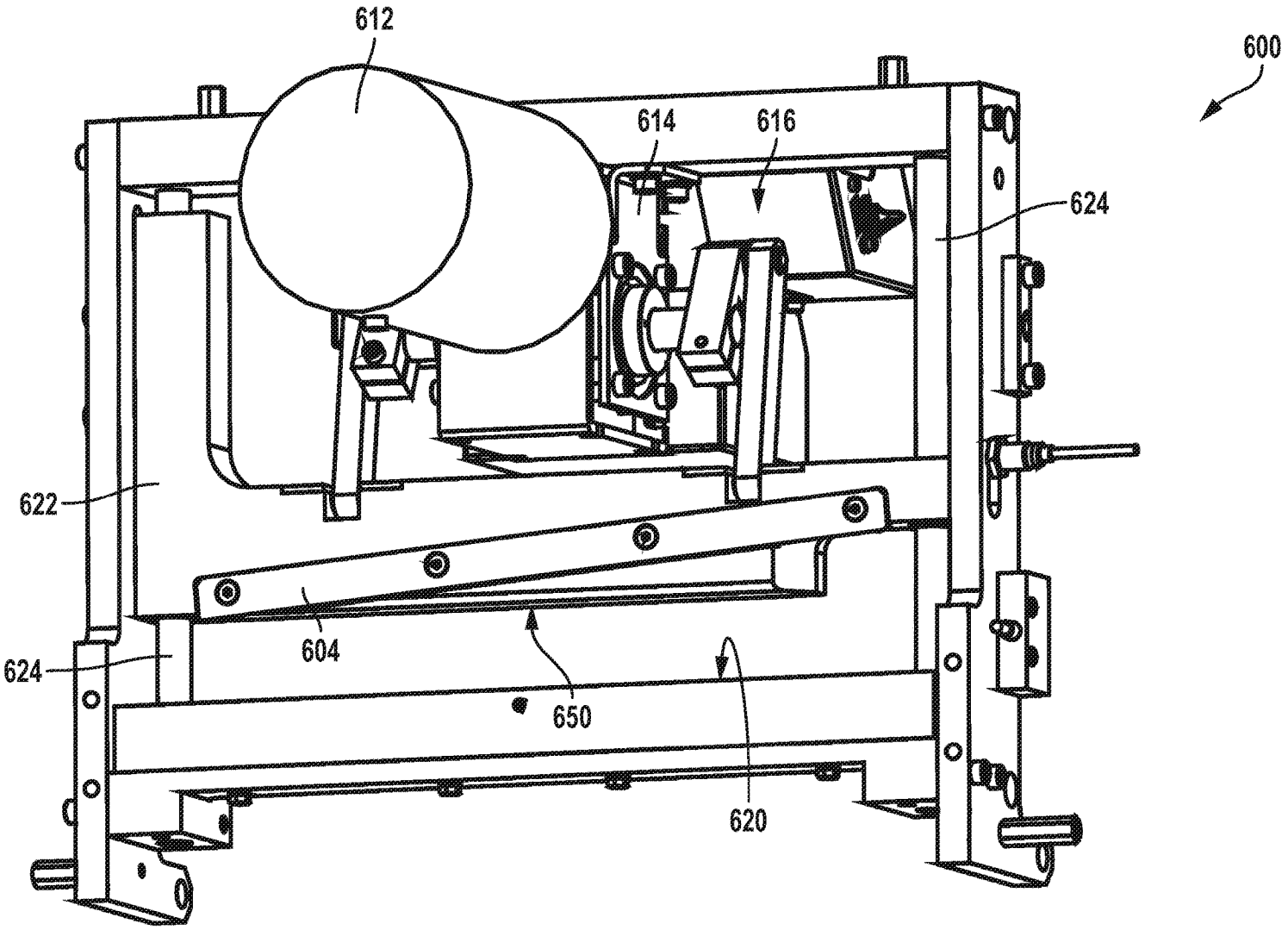
FIG. 17 is another front perspective view of a cutting assembly provided by the present invention.
Figure 18:
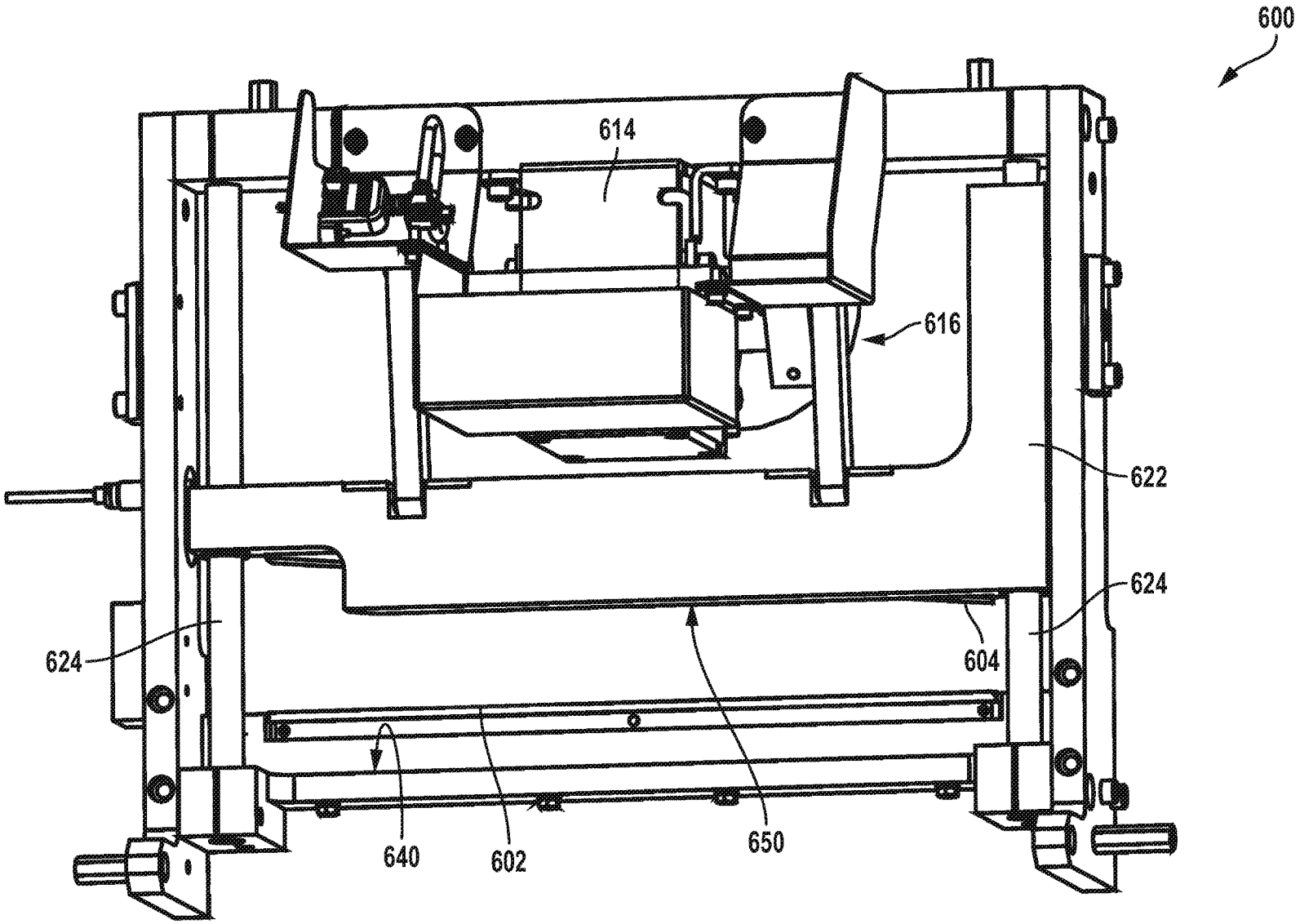
FIG. 18 is a rear perspective view of the cutting assembly of FIG. 17.
Figure 19:
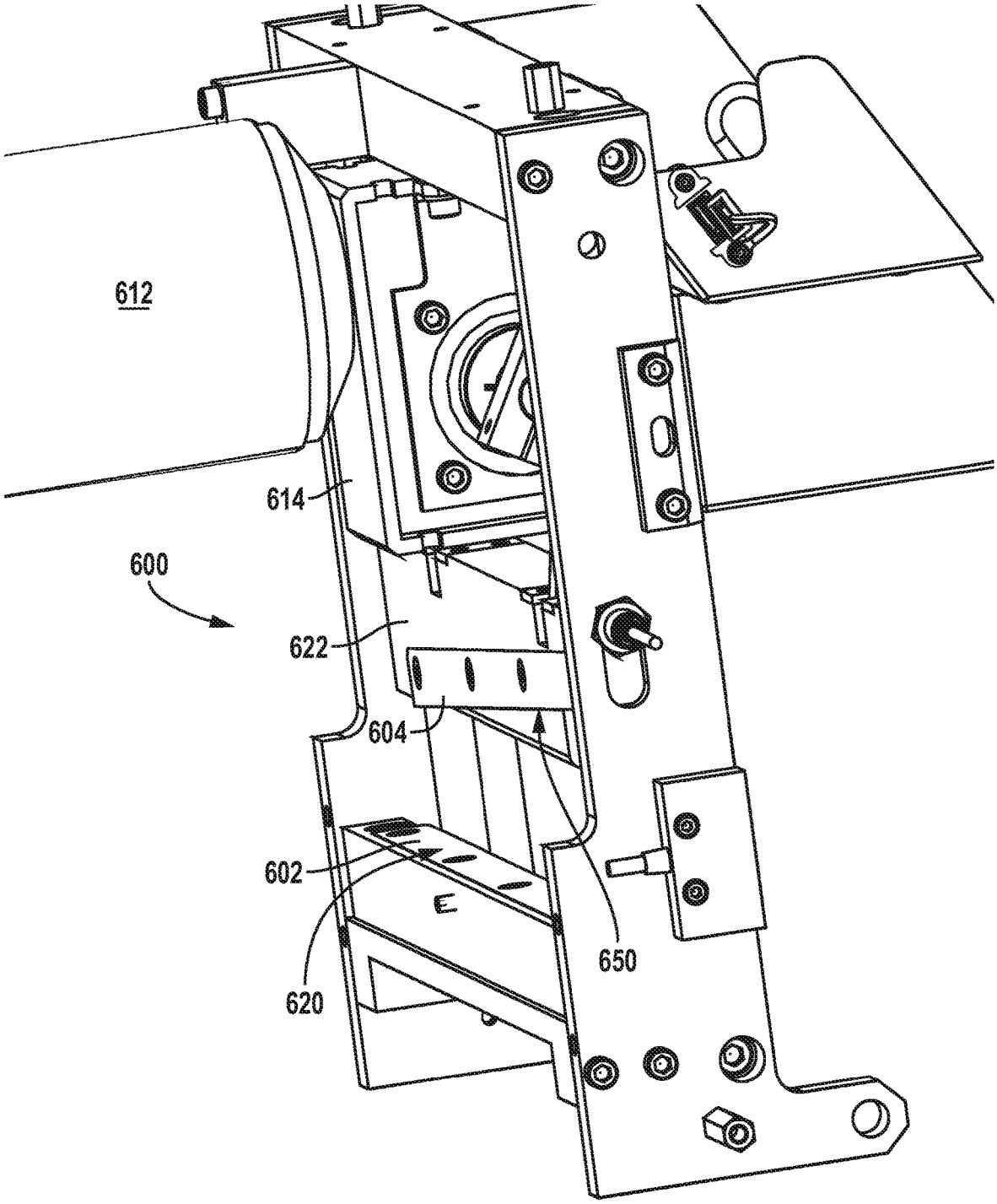
FIG. 19 is an enlarged front perspective view of cutting assembly of FIG. 17.
Figure 20:
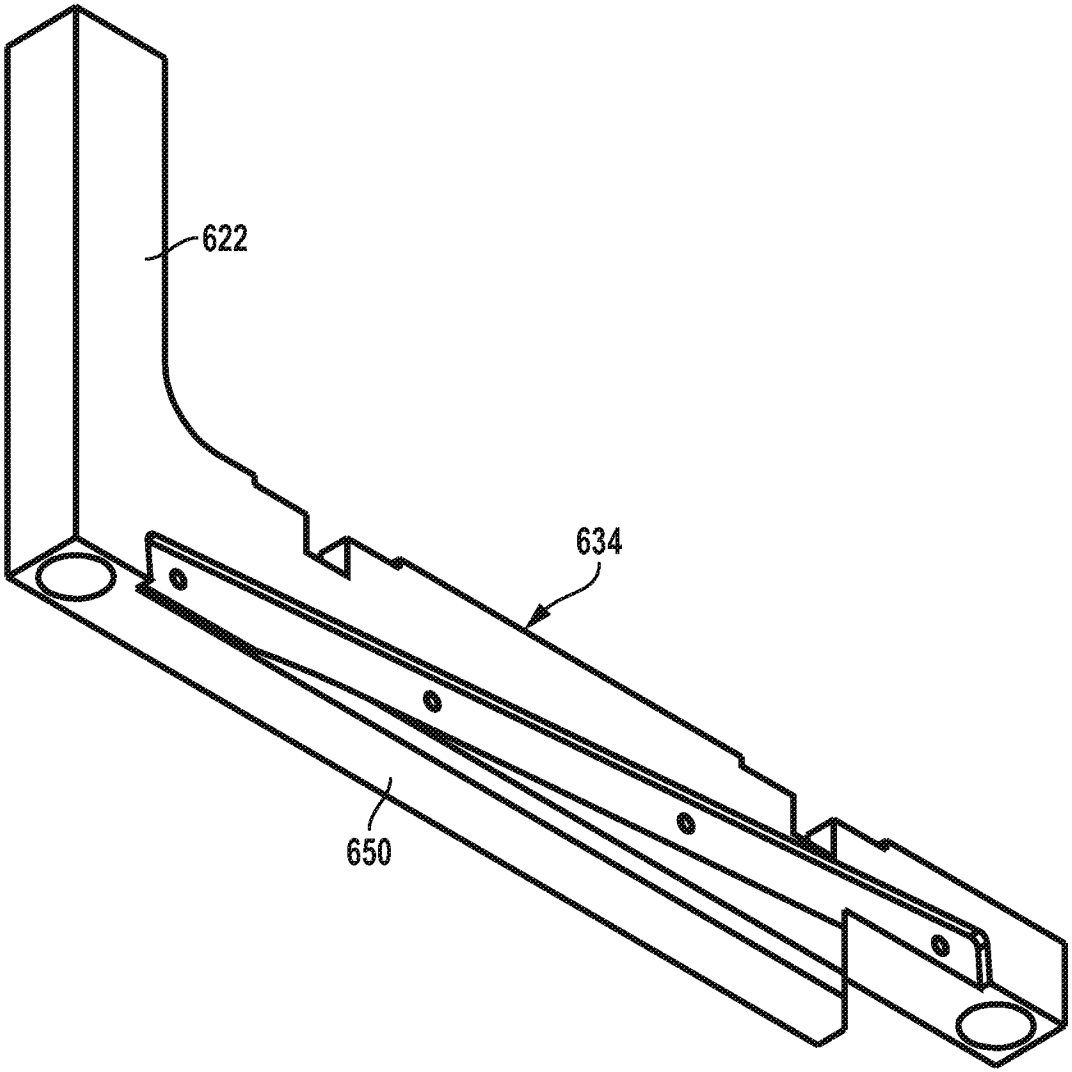
FIG. 20 is a front perspective view of a cutting blade carriage of the cutting assembly of FIG. 17.

The resulting dunnage product 209, shown in FIG. 2, includes at least one, and preferably a plurality, of laterally-spaced, longitudinally-extending connecting bands 266 where the sheet stock material is embossed or pierced or punched or otherwise connected to hold multiple plies 262 and 264 of stock material together. The stock material generally is compressed in these connecting bands 266 and thus the crumpled plies 262 and 264 provide relatively greater loft in cushioning regions outside the connecting bands 266. If the crumpled portions are cut, the random nature of the crumpling may lead to the formation of loose shards of sheet stock material where the stock material crosses a plane through which a cutting mechanism acts. By reducing or eliminating the crumpling in a portion of the sheet material, the likelihood of generating loose shards of sheet stock material is greatly diminished.

A packaging system 322 including an exemplary dunnage conversion machine 300 is shown in FIGS. 3-13. The packaging system 322 includes the conversion machine 300, a conveyor 318 for transporting containers 324 to a packaging location adjacent an outlet 316, and a control sensor 326 mounted adjacent the conveyor 318 at a position upstream of the conversion machine 300. By measuring and/or inputting the conveyor speed, a controller 330 incorporated into the conversion machine 300 or remote from the conversion machine 300 can use a signal from the control sensor 326 to trigger a timer. The length of time from when the sensor 326 is triggered until a container 324 on the conveyor 318 is no longer sensed by the sensor 326 can be used to determine the length of the container 324 and thereby the length of an appropriate wrapping dunnage product. The controller 330 can automatically determine the appropriate length and control the conversion machine 300 to dispense the wrapping dunnage product directly to the container. The controller 330 is essentially the same as the controller 211 described above.

A suitable application for such a system 322 would arise when a wrapping dunnage product will be used as a bottom or top layer in the container. Consequently, the production of a wrapping dunnage product for layering in a container can be automated and a wrapping product of the appropriate length can be provided automatically and on demand in a more compact configuration than a pre-produced supply of wrapping dunnage material.

The dunnage conversion machine 300 generally includes a housing 302 that surrounds or incorporates both a conversion assembly that includes a feed assembly 304 and a connecting assembly 306, and a cutting assembly 306. The housing 302 is mounted to a stand 314 to raise the outlet 316 of the housing 302 above a packaging surface provided by the conveyor 318.

The illustrated conversion machine 300 includes a series of serpentine guides 354, typically formed of bars or rollers with parallel spaced axes, upstream of the feed assembly 304. These guides 354 define a serpentine path for the sheet stock material as it travels from a supply or supplies to the feed assembly 304. These guides 354 help to provide a relatively consistent tension on the stock material coming from the supply, particularly when the supply includes a fan-folded stock material. The guides 354 also may improve tracking, so that the stock material enters the feed assembly 304 in a more consistent lateral location.

From the serpentine guides 354, each ply $P_1$ and $P_2$ enters the feed assembly 304 on a respective side of a separator plate 384 that extends between rotating members, such as wheels 372 and 374, of the feed assembly 304 and defines a passage for each ply $P_1$ and $P_2$ between upper and lower channel guides 386 and 388. The channel guides 386 and 388 flare outward, away from one another, at an upstream end to receive the plies, and then extend parallel to each other through the feed assembly 304 and the connecting assembly 306 to guide the stock material therethrough to the cutting assembly 310. The channel guides 386 and 388 also confine the stock material between the feed assembly 304 and the connecting assembly 306.

At an upstream end of the feed assembly 304 at least one ply is separated from at least one other ply. Typically only two plies $P_1$ and $P_2$ are used, and the two plies follow different paths into the feed assembly 304. This is accomplished with a separator 384 extending therefrom in a downstream direction into the feed assembly 304 and between laterally spaced-apart rotating members or wheels 372 and 374 that form part of the feed assembly 304. These rotating member pairs 372 and 374 are laterally spaced on opposite sides of the separator 384 or engage one another through laterally-spaced openings in the separator 384.

Above and below the separator 384, upper and lower channel guide members 386 and 388 or channel guide plates define a path through the feed assembly 304 and the connecting assembly 306 that constrain movement of the sheet stock material passing between the feed assembly 304 and the connecting assembly 306. These channel guide members 386 and 388 define the upper and lower boundaries that confine the sheet stock material therein to facilitate the crumpling of the stock material between the feed assembly 304 and the slower speed connecting assembly 306. In addition, the separator 384 generally is parallel to the upper and lower guide members 386 and 388, but may be closer to one of the guide members 386 and 388. Consequently, the stock material passes on either side of, in this case above and below the separator 384, whereby the stock material on either side will fold and crumple randomly and asymmetrically. Longitudinal crumpling creates fold lines extending approximately transverse the longitudinal dimension of the stock material, which generally is perpendicular to the path of the stock material through the machine 300. The sheet stock material thus contained between the feed assembly 304 and the slower connecting assembly 306 is randomly crumpled, creating fold lines with random lengths and orientations, and an irregular pitch between the folds.

The asymmetrical folding and crumpling provided by the different spacing of the channel guide members 386 and 388 and the separator 384 yields two differently crumpled sheets generally having waveforms with independent frequencies and amplitudes in the irregular crumpling of the sheet material. Accordingly, the different size ply in-feed chambers or passages defined by the channel guide members 386 and 388 and the separator 384 allow the plies to randomly crumple with different frequencies and amplitudes so the plies are less likely to interlock when they are brought together, thereby providing more loft after the plies are connected. Without the separator 384, the plies would nest into each other to create a thinner, less supportive dunnage product.

The feed assembly 304 includes upper and lower rotating member 372 and 374 that form pairs of laterally-spaced rotating members, in this case wheels, for advancing the sheet stock material therebetween. The upper rotating members 372 engage and advance an upper ply of sheet material and the lower rotating members 374 engage and advance a lower ply of sheet material. The rotating members 372 and 374 are mounted on respective common laterally-extending shafts 390 and 391, and the upper rotating members 372 are pivotably mounted and biased against the lower rotating members 374.

The rotating members 372 and 374 have a surface that provides sufficient friction to grip the stock material, and may be knurled or have a rubber or other high-friction surface, for example, to provide the desired grip on the stock material. The feed assembly 304 may include one pair of rotating members, a single rotating member on one side of the sheet stock material and multiple rotating members on the other side of the stock material, or as shown, multiple laterally-spaced pairs of rotating members 372 and 374 for advancing the sheet stock material therethrough. The opposing rotating members 372 and 374 in each pair preferably, but not necessarily, are biased against one another to maintain a grip on the sheet stock material passing therebetween.

The wheel shaft 390 is supported at its lateral ends by a pair of opposing housing blocks 392 mounted outside the lateral side plate frame members 394, a pair of lifting plates 396 inward of the housing blocks 392, and a lifting cam shaft 400. Each housing block 392 houses a compression spring 402 to bias the upper and lower rotating members or wheels 372 and 374 toward one another. The housing block 392 has a recess or pocket 404 that receives an end of the lifting cam shaft 400 and holds it in place, and through-slots 406 that allows the wheel shaft 390 to translate vertically on parallel guides. The wheel shaft 390 has a hole 410 near its end where a bolt 408 passes through to act as a spring compressor as well as the guide for linear movement of the wheel shaft 390.

The lifting cam shaft 400 is in-line with, parallel to, and above the wheel shaft 390 in the illustrated embodiment. The lifting shaft 400 spans the full width of the feed assembly 304 and its lateral ends are captured within the pockets 404 in the housing blocks 392. One side of each end of the lifting cam shaft 400 is milled down to a flat 411 such that the lifting cam shaft 400 sits below its tangency on the flats 411 in the pockets 404 of the housing blocks 392. The lifting plates 396 have a clearance hole for the cam shaft 400 and a slot for the wheel shaft 390 to allow the translation motion of the wheel shaft therein.

A hole toward the center of the lifting cam shaft 400 receives a lever arm 412 that can extend outside the housing 302 of the conversion machine 300. The hole and the lever arm 412 are parallel to the flats 411 in the illustrated embodiment. Rotating the lever arm 412 through ninety degrees from an operating position to a loading position rotates the ends of the cam shaft 400 off their flats 411 onto their round portions. The lifting plates 396 transfer this rotational motion to the wheel shaft 390, and thus to the upper rotating members or wheels 372, thereby providing a gap between the upper and lower wheels 372 and 374, between which the sheet stock material can be fed without obstruction all the way to rotating gears 414 and 416 in the connecting assembly 306. Once the stock material is loaded, returning the lever arm 412 to its operating position closes the gap between the upper and lower wheels 372 and 374 of the feed assembly 304. In the operating position, the spring 402 biases the shaft 390 of the upper wheels 372 toward against the lower wheels 374, now with the stock material therebetween.

The dunnage conversion machine 300 may further include laterally spaced-apart forming plows 312 between the feed assembly 304 and the connecting assembly 306 that reduce the width of the stock material and inwardly fold the free lateral edges as the stock material passes thereby. The forming plows 312 each have a curved surface that is mounted to extend into the path of the lateral edges of the stock material, gradually protruding further inward toward a downstream end thereof. As the lateral edges of the stock material are folded or turned inwardly by the lateral plows 312, the edges of the stock material of one layer can fold around and enclose the edges of the other layer, and the connecting assembly 306 then mechanically connects the overlapping layers together. This makes the lateral edges of the finished dunnage product more uniform, and the additional folding and the resulting additional layers passing through the connecting assembly 306 to form the connecting lines helps to hold the dunnage product together better. The conversion machine 300 defined by this feed assembly 304 and connecting assembly 306 provides approximately 40-55% crimp loss. This means that the wrap dunnage product that is produced is approximately 40-55% shorter than the stock material that is used to produce it.

The connecting assembly 306 includes paired rotating gear members or gears 414 and 416 that are biased together and connect the overlapped layers of stock material as the stock material passes between the gears. The illustrated connecting assembly 306 includes at least two rotating gear members 414 and 416 having interlaced teeth for deforming the sheet stock material passing therebetween, thereby mechanically interlocking multiple layers and multiple overlapping sheets along lines of connection to hold them together as a connected strip of dunnage. This mechanical connection is distinguished from a chemical or adhesive bond between the layers. The gear members 414 and 416 flatten, crease, fold, and/or punch the stock material as it passes therebetween. Although the connecting assembly 306 includes at least two rotating gear members 414 and 416 between which the stock material is fed, more gear members may be employed in various configurations.

The upper gears 414 are biased against the lower gears 416 by a biasing member, such as a spring. The biased rotating members 372 and 374 of the feed assembly 304 and the biased gears 414 and 416 of the connecting assembly 306 are each mounted in a cantilever fashion for rotation about respective pivots 240 and 241 so that a smaller spring can be used to provide sufficient biasing force.

The rotating gear members 414 and 416 generally are driven at a rate that is less than the rate that the feed assembly 304 advances the sheet stock material thereto to produce the desired random crumpling in the confined space between the feed assembly 304 and the connecting assembly 306. In the illustrated conversion machine 300, the feed assembly 304 and the connecting assembly 306 are driven by a common electric drive motor 242. The drive motor 242 positively drives the lower rotating members 374 of the feed assembly 304 and is connected to the lower gear members 416 of the connecting assembly 306 via a chain and suitable sprocket (not shown). The ratio of the speed between the rotating members 372 and 374 of the feed assembly 304 and the gears 414 and 416 of the connecting assembly 306 can readily be adjusted by adjusting the relative sizes of the sprockets and providing a suitable chain therebetween. Alternatively, separate motors can be provided to separately drive the feed assembly 304 and the connecting assembly 306. A transmission also may be provided instead of the chain drive, to provide the ability to change the relative speeds of the feed wheels 372 and 374 and the gears 414 and 416 without interrupting their operation.

To obtain the desired length of dunnage products, the conversion machine 300 includes the cutting assembly 310 downstream of the connecting assembly 306 for cutting or otherwise severing a discrete dunnage product having a desired length from the substantially continuous length of sheet stock material drawn from the supply. The cutting assembly 310 may include a rotatable cutting wheel, for example, that is movable across the path of the sheet stock material and a stationary blade against which the cutting wheel acts to cut the crumpled strip of dunnage therebetween. The cutting assembly 319 is not limited to use of a rotatable cutting wheel, however.

As shown in the illustrated embodiment, a separate cut motor 244 drives a guillotine-style cutting assembly 208 which includes a cutting blade 246 that extends across the width of the path of the dunnage strip and has a pair of crank arms 248 aligned with the laterally-spaced rotating members 216 and 218 of the feed assembly 204 and the gears 236 and 238 of the connecting assembly 206 to positively drive the cutting blade 246 through the layers of crumpled stock material with the most force applied at the lines of connection. The crank arms 248 are connected to a common shaft 250 and rotate through a cycle defined by respective cams 252.

The cutting assembly 310 includes a guillotine-style cutting blade 440 whose movement is directed by a twin four-bar linkage 442 and a slider assembly 444. A separate cut motor 445 drives the four-bar linkage 442 via a gear box 446. A drive shaft 448 symmetric about the gear box 446 has a drive crank 450 on opposing ends of the shaft 448. Each drive crank 450 is attached to a second crank 452 which in turn attaches to a carriage 453 that supports the cutting blade 440. The cutting blade carriage 453 rides on a pair of parallel shafts or slider arms 454 to guide the cutting blade 440 as it moves across the path of the strip of dunnage to sever a discrete length of a wrapping dunnage product from the strip. Each of the crank arms 450 is aligned with one of the laterally-spaced gear pairs 414 and 416 of the connecting assembly 306 to concentrate the force applied to cutting the strip of dunnage at the connecting lines, which are the areas of maximum resistance to being cut.

The cutting blade carriage 453 has an angled surface 456 behind the blade edge. This angle removes any flat surface upon which slivers of the cut dunnage product could rest. From the cutting blade 440, the housing exit chute 460 continues a downward slope out of the machine 300. This allows the next strip of dunnage formed in series to sweep out the remnants from the previous strip of dunnage.

As discussed above, during the formation of randomly-crumpled dunnage products, loose shards of sheet stock material may be generated when the dunnage products are cut to a desired length. These shards can cause problems, both aesthetic and in the proper function of the dunnage conversion machine 300. The present invention provides a way to minimize or eliminate this problem. One solution is to lift the upper feed wheels 372 from the lower feed wheels 374 before the dunnage product is cut, for example using a solenoid motor 500 connected to the lever arm 412. The controller 330 is connected to and otherwise is configured to control the solenoid motor 500 to disengage the upper feed wheels 372 from the lower feed wheels 374. This causes the feed assembly 304 to disengage from the stock material, whereby only the connecting assembly 306 is drawing the sheet material through the conversion assembly. Alternatively, the feed assembly 304 could be controlled to feed sheet stock material at the same or a slower feed rate than the connecting assembly 306 to minimize or eliminate longitudinal crumpling in a portion of the strip of dunnage. With either of these techniques, crumpling is reduced or eliminated in a portion of the sheet stock material while in effect. This reduced-crumpling zone is flatter and has less cushioning ability than a regularly-crumpled portion of the sheet stock material. This reduced-crumpling portion can then be cut once the connecting assembly 306 advances the reduced-crumpling portion to the cutting assembly 310. The lower amount of crumpling greatly decreases the likelihood that loose shards of sheet material will be generated during the cutting operation.

Accordingly, a dunnage conversion machine provided by the invention converts a sheet stock material into a dunnage product that is relatively thicker and less dense than the sheet stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the conversion assembly temporarily advances the sheet stock material therethrough while minimizing or eliminating the random crumpling of the sheet stock material in a reduced-crumpling zone, and then cuts the sheet stock material in the reduced-crumpling portion or zone to reduce or eliminate the production of scrap shards of sheet stock material. A solenoid may be used to lift the upper feed wheels 372 to reduce or eliminate the crumpling.

Another cutting assembly 600 provided by the present invention will be described with reference to FIGS. 14-20. Similar to the foregoing embodiment, a dunnage conversion machine provided by this embodiment includes (a) means for advancing a sheet stock material and randomly crumpling at least a portion of the sheet stock material to form a strip of dunnage, (b) means for reducing the crumpling in a portion of the strip of dunnage, and (c) means for cutting the reduced-crumpling portion of the strip of dunnage to sever a discrete dunnage product from the strip of dunnage. The conversion assembly described above, or another conversion assembly, would be suitable for producing the randomly-crumpled sheet stock material and resulting strip of dunnage. In contrast to the foregoing embodiment, however, the amount or degree of crumpling is reduced downstream of the conversion assembly, at or adjacent the cutting assembly 600, such as by stretching the randomly crumpled strip of dunnage.

More particularly, as in the foregoing examples the present invention provides a dunnage conversion machine for converting a sheet stock material into a relatively lower density dunnage product that includes a conversion assembly configured to advance a sheet stock material therethrough along a path from an upstream end toward a downstream end and to randomly crumple at least a portion of the sheet stock material, and a cutting assembly downstream of the conversion assembly.

As in the foregoing example, the conversion assembly may include a feed assembly for advancing at least a first web of sheet stock material therethrough at a first rate, and a connecting assembly downstream of the feed assembly that (a) retards the advancement of the sheet stock material by passing the sheet stock material therethrough at a second rate that is less than the first rate, thereby causing the first web to randomly crumple in a longitudinal space between the feed assembly and the connecting assembly, and (b) connects the crumpled first web to a second web to maintain the crumpled first web in its crumpled state. The feed assembly may include at least one pair of rotating members for advancing sheet stock material therebetween, and the connecting mechanism may include at least one pair of rotating gear members having interlaced teeth for deforming the sheet stock material passing therebetween to interlock multiple plies of sheet stock material. The conversion assembly also may include one or more tunnel members that define a path for the sheet stock material through the conversion assembly.

The cutting assembly 600 is similar to the cutting assembly 310 (FIG. 4) described above, and includes a stationary cutting blade 602 on one side of the path of the sheet stock material in the strip of dunnage and a movable cutting blade 604 that is movable from a conversion position removed from the path of the sheet stock material opposite the stationary cutting blade 602, across the path to a cut position adjacent the stationary cutting blade 602. In contrast to the foregoing cutting assembly, however, in this embodiment the cutting assembly 600 may further include an upstream flattening plow 606 upstream of the stationary cutting blade 602 and a downstream flattening plow 608 downstream of the movable cutting blade 604. The upstream and downstream flattening plows 606 and 608 engage and stretch the randomly crumpled sheet stock material therebetween over the stationary cutting blade 602, thereby reducing the amount of crumpling in a portion of the strip of dunnage between the upstream and downstream flattening plows 606 and 608. As a result, the movable cutting blade 604 passes through a reduced-crumpling portion of the strip of dunnage, and thus through fewer layers of sheet material and produces fewer shards.

As in the preceding embodiment, the illustrated cutting assembly 600 includes a cut motor 612 coupled to a gear box 614 and sets of laterally-spaced crank arms 616 to drive the movable cutting blade 604 across a path of the sheet stock material and then past the stationary cutting blade 602 mounted at a downstream side of an anvil surface 620. The movable cutting blade 604 is carried in cutting blade carriage 622 that rides on a pair of parallel guide shafts or slider arms 624, which guide the movable cutting blade 604 across the path of the strip of dunnage and the stationary cutting blade 602 to sever a discrete length of a dunnage product from the strip.

The cutting blade carriage 622 supports the movable cutting blade 604 at an angle relative to the parallel guide shafts 624, which extend in a direction generally perpendicular to the stationary cutting blade 602, such that the movable cutting blade 604 engages the stationary cutting blade 602 at one lateral side of the path of the strip of dunnage, and a contact point between the movable cutting blade 604 and the stationary cutting blade 602 moves across the width of the path as the cutting blade carriage 622 moves past the stationary cutting blade 602.

In the illustrated embodiment, the upstream and downstream flattening plows 606 and 608 are mounted to the cutting blade carriage 622 for movement with the movable cutting blade 604. In the illustrated embodiment, the upstream flattening plow 606, also referred to as the infeed plow, includes a pair of laterally-spaced brackets 630 on an upstream side of the cutting blade carriage 622. The brackets 630 are connected to respective bearing blocks 632 spring-biased against an upper surface 634 of the cutting blade carriage 622 by respective spring assemblies 636 carried on the cutting blade carriage 622. At opposite ends of the brackets 630, spaced from the bearing blocks 632, the brackets 630 are connected by a clamping bar 638 extending therebetween. The infeed plow 606 is configured such that as the cutting blade carriage 622 moves toward the stationary cutting blade 602, the clamping bar 638 will engage and clamp or pinch the sheet material against the anvil surface 620 upstream of and adjacent the stationary cutting blade 602. The force applied by the infeed plow 606 upstream of the stationary cutting blade 602 increases under the spring-biasing force as the cutting blade carriage 622 continues to move toward the stationary cutting blade 602, drawing the movable cutting blade 604 across the path of the strip of dunnage and past the stationary cutting blade 602.

Continuing downstream of the stationary cutting blade 602, the downstream flattening plow 608 extends below and leads the movable cutting blade 604 as the cutting blade carriage 622 moves the movable cutting blade 604 toward the stationary cutting blade 602. The downstream flattening plow 608, also referred to as the outfeed plow, may be mounted to the cutting blade carriage 622, and is configured to engage the strip of dunnage downstream of the stationary cutting blade 602. As the cutting blade carriage 622 moves toward the stationary cutting blade 602 the outfeed plow 608 pushes the strip of dunnage past the stationary cutting blade 602 and toward a downstream bearing surface 640 parallel to but offset from or displaced from the anvil surface 620 upstream of the stationary cutting blade 602.

The infeed plow 606 is configured to engage the strip of dunnage and the anvil surface 620 upstream of the stationary cutting blade 602 before the outfeed plow 608 pushes the strip of dunnage past the anvil surface 620 and the stationary cutting blade 602. Thus, the infeed plow 606 grasps the strip of dunnage upstream of the stationary cutting blade 602, and then the outfeed plow 608 subsequently pushes the strip of dunnage past the stationary cutting blade 602 and stretches the randomly-crumpled sheet stock material in the strip of dunnage, forming a portion or zone of the strip of dunnage with reduced crumpling between the infeed plow 606 and the outfeed plow 608 so that the trailing movable cutting blade 604 will cut the reduced-crumpling portion stretched over the stationary cutting blade 602.

While the infeed plow 606 and the outfeed plow 608 are mounted to the cutting blade carriage 622 in the illustrated embodiment, the infeed plow 606 and the outfeed plow 608 may be independently supported and actuated to engage and stretch the strip of dunnage to reduce the crumpling in a portion of the strip adjacent the stationary cutting blade 602. Moreover, in some situations one or both of the infeed plow 606 and the outfeed plow 608 may be omitted or combined with other elements while continuing to provide means for reducing the crumpling adjacent the stationary cutting blade 602.

Referring now particularly to FIGS. 17 to 20, for example, the cutting blade carriage 622 itself may additionally or alternatively facilitate stretching the strip of dunnage over the stationary cutting blade 602 by acting as or in addition to the downstream flattening plow 608. This is accomplished by configuring the cutting blade carriage 622 to include a leading surface 650 that extends ahead of the movable cutting blade 604 such that the leading surface 650 pushes strip of dunnage past the stationary cutting blade 602 ahead of the movable cutting blade 604. At the end of the cutting stroke, with the cutting blade carriage 622 at its furthest point past the stationary cutting blade 602, the leading surface 650 may engage the downstream bearing surface 640, but by pushing a portion of the strip of dunnage downstream of the stationary cutting blade 602 ahead of the movable cutting blade 604, the strip of dunnage may be stretched between the leading surface 650 of the cutting blade carriage 622 and the upstream flattening plow 606, if employed, or alternatively the conversion assembly, such as the connecting assembly 306 (FIG. 4) described above. In the latter case, the distance between the cutting assembly 600 and the connecting assembly may be minimized.

As discussed above, during the formation of randomly-crumpled dunnage products, loose shards of sheet stock material may be generated when the dunnage products are cut to a desired length as the movable cutting blade moves across the layers of sheet material interposed between the movable cutting blade and the stationary cutting blade. By stretching the crumpled sheet stock material, crumpling in a portion of the sheet stock material extending through the cutting assembly is reduced or minimized. This reduced-crumpling portion or zone is flatter and has less cushioning ability than a randomly-crumpled portion of the sheet stock material produced by the conversion assembly. But the lower amount of crumpling greatly decreases the likelihood that loose shards of sheet material will be generated during the cutting operation, thereby minimizing or eliminating the problems created by such shards.

The present invention also provides a corresponding method for converting a sheet stock material into a relatively lower density dunnage product, that includes the following steps: (a) advancing a sheet stock material through a conversion assembly and randomly crumpling at least a portion of the sheet stock material to form a strip of dunnage, (b) stretching the strip of dunnage to reduce the crumpling in a portion of the strip of dunnage, and (c) cutting the reduced-crumpling portion of the strip of dunnage to sever a discrete dunnage product from the strip of dunnage.

The randomly crumpling step may include the steps of (i) retarding the passage of the sheet stock material downstream of the feed assembly portion of the conversion assembly by passing the sheet stock material at a second rate that is less than the first rate to cause the first web to randomly crumple, and (ii) connecting multiple layers of sheet stock material, including connecting the crumpled first web to one side of a second web of sheet stock material, to hold the crumpled first web in its crumpled state.

In summary, the present invention provides a dunnage conversion machine that converts a sheet stock material into a dunnage product that is relatively thicker and less dense than the stock material. The conversion machine includes a conversion assembly that draws the sheet stock material therethrough and randomly crumples at least a portion of the sheet stock material. Before severing a discrete dunnage product of a desired length from the substantially continuous length of sheet stock material, the random crumpling is minimized or eliminated in an area to be cut to reduce or eliminate the production of scrap shards of sheet stock material during the cutting operation. This can be accomplished, as described in the foregoing examples, by reducing the amount or degree of crumpling in a portion of the sheet material to be cut, or by stretching the randomly-crumpled sheet material to reduce the crumpling in a portion of the sheet material to be cut.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

The invention claimed is:

1. A dunnage conversion machine for converting a sheet stock material into a relatively lower density dunnage product, comprising:

a conversion assembly configured to advance a sheet stock material therethrough along a path from an upstream end toward a downstream end and to randomly crumple at least a portion of the sheet stock material; and a cutting assembly downstream of the conversion assembly that includes a stationary cutting blade on one side of the path of the sheet stock material and a movable cutting blade that is movable from a conversion position removed from the path of the sheet stock material opposite the stationary cutting blade, across the path to a cut position adjacent the stationary cutting blade;

wherein the cutting assembly further includes an upstream flattening plow coupled to an upstream side of the movable cutting blade for movement therewith and a downstream flattening plow coupled to a downstream side of the movable cutting blade for movement therewith;

wherein the upstream flattening plow is coupled to the movable cutting blade with a spring assembly and is configured such that as the movable cutting blade moves toward the stationary cutting blade a portion of the upstream flattening plow will engage and clamp or pinch the sheet material against an anvil surface upstream of and adjacent the stationary cutting blade before the movable cutting blade engages the stationary cutting blade and as the movable cutting blade continues to move across the path of the strip of dunnage and past the stationary cutting blade;

wherein the downstream flattening plow is coupled to the movable cutting blade in a fixed position and extends below and leads the movable cutting blade as the movable cutting blade moves toward the stationary cutting blade such that as the movable cutting blade moves toward the stationary cutting blade the downstream flattening plow extends past the stationary cutting blade before the movable cutting blade engages the stationary cutting blade and pushes the strip of dunnage past the stationary cutting blade and toward a downstream bearing surface that is offset from or displaced from the anvil surface upstream of the stationary cutting blade.

2. A dunnage conversion machine as set forth in claim 1, where the conversion assembly includes:

a feed assembly for advancing at least a first web of sheet stock material therethrough at a first rate; and a connecting assembly downstream of the feed assembly that (a) retards the advancement of the sheet stock material by passing the sheet stock material therethrough at a second rate that is less than the first rate, thereby causing the first web to randomly crumple in a longitudinal space between the feed assembly and the connecting assembly, and (b) connects the crumpled first web to a second web to maintain the crumpled first web in its crumpled state.

3. A conversion machine as set forth in claim 2, wherein the feed assembly includes at least one pair of rotating members for advancing sheet stock material therebetween.

4. A conversion machine as set forth in claim 2, wherein the connecting assembly includes at least one pair of rotating gear members having interlaced teeth for deforming the sheet stock material passing therebetween to interlock multiple plies of sheet stock material.

5. A conversion machine as set forth in claim 1, wherein the conversion assembly includes one or more tunnel members that define a path for the sheet stock material through the conversion assembly.

6. A conversion machine as set forth in claim 1, wherein the cutting assembly further includes a cut motor coupled to a gear box and at least two sets of laterally-spaced crank arms to drive the movable cutting blade across a path of the sheet stock material and past the stationary cutting blade mounted at a downstream side of an anvil surface.

7. A conversion machine as set forth in claim 6, wherein the movable cutting blade is carried in a cutting blade carriage that rides on a pair of parallel guide shafts that guide the movable cutting blade across the path of the strip of dunnage and the stationary cutting blade to sever a discrete length of a dunnage product from the strip.

8. A conversion machine as set forth in claim 7, wherein the cutting blade carriage supports the movable cutting blade at an angle relative to the parallel guide shafts, which extend in a direction generally perpendicular to the stationary cutting blade, such that the movable cutting blade engages the stationary cutting blade at one lateral side of the path of the strip of dunnage, and a contact point between the movable cutting blade and the stationary cutting blade moves across the width of the path as the cutting blade carriage moves past the stationary cutting blade.

9. A conversion machine as set forth in claim 7, wherein the upstream and downstream flattening plows are mounted to the cutting blade carriage for movement with the movable cutting blade.

10. A dunnage conversion machine for converting a sheet stock material into a relatively lower density dunnage product, comprising:

a conversion assembly configured to advance a sheet stock material therethrough along a path from an upstream end toward a downstream end and to randomly crumple at least a portion of the sheet stock material; and a cutting assembly downstream of the conversion assembly that includes a stationary cutting blade on one side of the path of the sheet stock material and a movable cutting blade that is movable from a conversion position removed from the path of the sheet stock material opposite the stationary cutting blade, across the path to a cut position adjacent the stationary cutting blade;

wherein the cutting assembly further includes an upstream flattening plow coupled to an upstream side of the movable cutting blade for movement therewith and a downstream flattening plow coupled to a downstream side of the movable cutting blade for movement therewith;

wherein the movable cutting blade is carried in a cutting blade carriage that rides on a pair of parallel guide shafts that guide the movable cutting blade across the path of the strip of dunnage and the stationary cutting blade to sever a discrete length of a dunnage product from the strip;

wherein the upstream and downstream flattening plows are mounted to the cutting blade carriage for movement with the movable cutting blade;

wherein the upstream flattening plow includes a pair of laterally-spaced brackets on an upstream side of the cutting blade carriage, the brackets are connected to respective bearing blocks spring-biased against an upper surface of the cutting blade carriage by respective spring assemblies carried on the cutting blade carriage, and at opposite ends of the brackets, spaced from the bearing blocks, the brackets are connected by a clamping bar extending therebetween; the upstream flattening plow is configured such that as the cutting blade carriage moves toward the stationary cutting blade, the clamping bar will engage and clamp or pinch the sheet material against the anvil surface upstream of and adjacent the stationary cutting blade as the cutting blade carriage continues to move toward the stationary cutting blade, drawing the movable cutting blade across the path of the strip of dunnage and past the stationary cutting blade.

11. A conversion machine as set forth in claim 10, wherein the downstream flattening plow extends below and leads the movable cutting blade as the cutting blade carriage moves the movable cutting blade toward the stationary cutting blade.

12. A conversion machine as set forth in claim 11, wherein the downstream flattening plow is mounted to the cutting blade carriage and is configured such that as the cutting blade carriage moves toward the stationary cutting blade the downstream flattening plow pushes the strip of dunnage past the stationary cutting blade and toward a downstream bearing surface parallel to but offset from or displaced from the anvil surface upstream of the stationary cutting blade.

13. A conversion machine as set forth in claim 12, wherein the upstream flattening plow is configured to engage the strip of dunnage and the anvil surface upstream of the stationary cutting blade before the outfeed plow pushes the strip of dunnage past the anvil surface and the stationary cutting blade.

* * * * *